US010852693B2

(12) United States Patent
Asami

(10) Patent No.: US 10,852,693 B2
(45) Date of Patent: Dec. 1, 2020

(54) IMAGE FORMING APPARATUS

(71) Applicant: CANON KABUSHIKI KAISHA, Tokyo (JP)

(72) Inventor: Jun Asami, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/823,197

(22) Filed: Mar. 18, 2020

(65) Prior Publication Data

US 2020/0310346 A1 Oct. 1, 2020

(30) Foreign Application Priority Data

Mar. 27, 2019 (JP) ..... 2019-061984

(51) Int. Cl.
*G03G 21/20* (2006.01)
*G03G 15/16* (2006.01)
*G03G 15/00* (2006.01)

(52) U.S. Cl.
CPC ..... *G03G 21/203* (2013.01); *G03G 15/1615* (2013.01); *G03G 15/80* (2013.01)

(58) Field of Classification Search
CPC ..... G03G 21/203
See application file for complete search history.

(56) References Cited

U.S. PATENT DOCUMENTS

2009/0080919 A1* 3/2009 Okada ..... G03G 15/6564 399/45

FOREIGN PATENT DOCUMENTS

| | | | |
|---|---|---|---|
| JP | H10-142975 | A | 5/1998 |
| JP | 2001-51516 | A | 2/2001 |
| JP | 2009-251502 | A | 10/2009 |
| JP | 2012-42641 | A | 3/2012 |

* cited by examiner

*Primary Examiner* — Victor Verbitsky
(74) *Attorney, Agent, or Firm* — Canon U.S.A., Inc. I.P. Division

(57) ABSTRACT

An image forming apparatus includes a transfer member to transfer a toner image borne on s photosensitive member onto a conveyed recording material on receiving voltage from a power supply. Where an image is formed at a transfer portion on a first recording material and a subsequent second recording material, a time interval is changed to a first or second interval based on information concerning the transfer onto the first recording material. The second recording material has a second width greater than a first width of the first recording material. The time interval is from when a first recording material trailing edge passes through the transfer portion to when a second recording material leading edge reaches the transfer portion. The photosensitive member rotates one or less rotations during the first interval and rotates one or more rotations during the second interval.

15 Claims, 17 Drawing Sheets

IMAGE FORMING APPARATUS

BACKGROUND

Field

The present disclosure relates to an electrophotographic image forming apparatus, such as a copier, a printer, or a facsimile machine.

Description of the Related Art

A conventional electrophotographic image forming apparatus applies a charging bias to a charging unit, thereby charging a surface of a photosensitive member (an image bearing body) at a charging location to a predetermined potential. The charged surface of the photosensitive member is then exposed to light to form an electrostatic latent image thereon, and the electrostatic latent image is developed with toner to form a toner image. The toner image formed on the photosensitive member is electrostatically transferred to a recording material by applying a transfer bias to a transfer unit in a transfer portion.

Japanese Patent Application Laid-Open No. H10-142975 proposes the following method. That is, based on a sheet size signal from an external apparatus such as a host computer, it is determined whether or not a large size sheet having a greater width than a small size sheet is to be fed immediately following the small size sheet. The sheet passing interval is increased if it is determined that the large size sheet is to be fed. By increasing the sheet passing interval and performing at least a plurality of charging processes on the surface of the photosensitive member, the electrostatic trace on the photosensitive member can be reduced to prevent occurrence of an image failure.

The "sheet passing interval" (referred to also as a "sheet interval") is the length of time (period) between the time at which the trailing edge of a recording material completely passes through the transfer nip portion and the time at which the leading edge of the immediately following recording material reaches the transfer nip portion.

SUMMARY OF THE INVENTION

There are issues regarding Japanese Patent Application Laid-Open No. H10-142975. If the sheet passing interval is always increased when a large size sheet is fed immediately following a small size sheet, the productivity of image formation may decrease, and the photosensitive member is excessively rotated so that wear of the photosensitive member and other members may be accelerated and the service life of those members may be reduced.

With the conventional electrophotographic image forming apparatus, when the toner image is transferred to a recording material having a relatively small width, a transfer current differs between a region through which the recording material passes and a region outside that region when viewed in the longitudinal direction of the transfer portion (direction substantially perpendicular to the movement direction of the surface of the photosensitive member). Because of the difference in transfer current, an electrostatic trace may remain on the surface of the photosensitive member, and the electrostatic trace may cause an image failure, specifically density unevenness, in an image formed on a recording material having a relatively large width immediately following the recording material having a relatively small width. In the following description, the recording material will also be referred to as "paper" or a "sheet" for convenience, although the recording material is not limited to paper or a sheet. Passage of the recording material through the transfer portion will be referred to also as "feeding". The region in the transfer portion through which the recording material passes when viewed in the longitudinal direction (direction substantially perpendicular to the movement direction of the surface of the photosensitive member) will be referred to as a "sheet-passing region", and the region outside the sheet-passing region (that is, the region through which no recording material passes) will be referred to as a "non-sheet-passing region". Furthermore, the regions of the photosensitive member and the transfer unit that correspond to the sheet-passing region and the non-sheet-passing region in the transfer portion will also be referred to as sheet-passing regions and non-sheet-passing regions, respectively, for convenience. The "width" of the recording material refers to the dimension in the direction substantially perpendicular to the movement direction of the surface of the photosensitive member (direction substantially perpendicular to the conveyance direction of the recording material). In addition, a recording material having a first width will also be referred to as a "small size sheet", and a recording material having a second width greater than the first width will also be referred to as a "large size sheet".

An aspect of the present disclosure is an image forming apparatus capable of reducing an image failure caused by an electrostatic trace remaining on an image bearing body in a case where a large size sheet is fed immediately following a small size sheet, while preventing the decrease of the productivity of image formation and the reduction of the service life of a member.

According to an aspect of the present disclosure, an image forming apparatus includes a photosensitive member that is rotatable and configured to bear a toner image, a transfer member configured to perform a transfer of the toner image borne on the photosensitive member onto a recording material, a power supply configured to apply a voltage for the performed transfer to the transfer member, a conveyance unit configured to convey the recording material to a transfer portion where the transfer member opposes the photosensitive member, and a control unit configured to control the conveyance unit, wherein, in a case where an image is successively formed on a first recording material and a second recording material conveyed to the transfer portion following the first recording material, the control unit changes a time interval to a first interval or a second interval based on predetermined information concerning the transfer onto the first recording material, wherein the first recording material has a first width in a width direction perpendicular to a conveyance direction of the recording material and the second recording material has a second width greater than the first width in the width direction, wherein the time interval is an interval between a time when a trailing edge of the first recording material in the conveyance direction completely passes through the transfer portion and a time when a leading edge in the conveyance direction of the second recording material conveyed to the transfer portion immediately following the first recording material reaches the transfer portion, and wherein the first interval is a time period corresponding to a rotation equal to less than one rotation of the photosensitive member and the second interval is a time period corresponding to a rotation equal to one rotation or more than one rotation of the photosensitive member.

Further features of the present disclosure will become apparent from the following description of exemplary embodiments with reference to the attached drawings.

DESCRIPTION OF THE EMBODIMENTS

Preferred embodiments of the present disclosure will now be described in detail in accordance with the accompanying drawings.

In the following, an image forming apparatuses according to the present disclosure will be described in more detail with reference to the drawings.

Embodiment 1

1. General Configuration and Operation of Image Forming Apparatus

Figure 1:
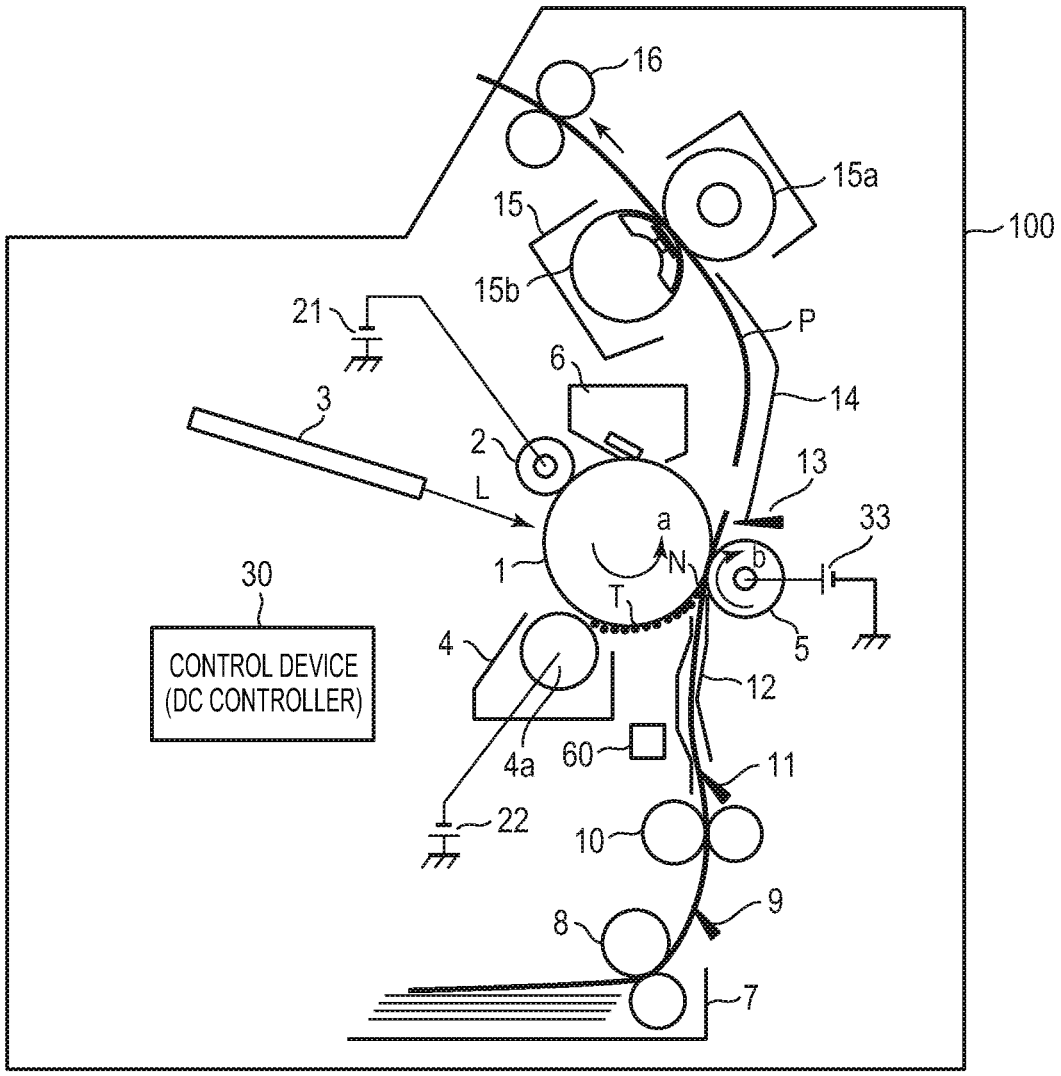
FIG. 1 is a schematic cross-sectional view of an image forming apparatus.

FIG. 1 is a schematic cross-sectional view of an electrophotographic image forming apparatus 100 according to an embodiment 1. The image forming apparatus 100 has a photosensitive drum 1, which is a rotatable drum-shaped type of a photosensitive member (an electrophotographic photosensitive member). Around the photosensitive drum 1, a charging roller 2, which is a roller-type charging member serving as a charging unit, an exposure device (a laser scanner device) 3 serving as an exposure unit, and a developing device 4 serving as a developing unit are arranged. Around the photosensitive drum 1, a transfer roller 5, which is a roller-type of a transfer member serving as a transfer unit, and a cleaning device 6 serving as a cleaning unit are also arranged. On the upstream side in the conveyance direction for a recording material P from a transfer nip portion (a transfer portion) N, which is formed by contact between the photosensitive drum 1 and the transfer roller 5, a sheet cassette 7, a sheet feed roller 8, a pre-feed sensor 9, a resist roller pair 10, a top sensor 11 and a transfer guide 12 are arranged. On the downstream side in the conveyance direction for the recording material P from the transfer nip portion N, an antistatic needle 13, a conveyance guide 14, a fixing device 15, and a sheet discharge roller pair 16 are arranged. The resist roller pair 10 is an example of a conveyance unit that conveys the recording material P to the transfer nip portion N. A control device 30 serving as a control unit controls driving and stopping of the resist roller pair 10 as a conveyance unit, thereby controlling the timing of feeding of the recording material P to the transfer nip portion N.

The photosensitive drum 1 is a negatively charged OPC photosensitive member and is rotationally driven in a direction indicated by an arrow "a" in the drawing (a counterclockwise direction) at a predetermined process speed (a circumferential speed) by a drive motor (not shown) serving as a drive unit. The charging roller 2 comes into contact with the surface of the photosensitive drum 1 under a predetermined pressing force. The charging roller 2 rotates following the rotation of the photosensitive drum 1. A charging power supply 21 then applies a charging bias of a charging polarity for the photosensitive drum 1 (a charging voltage) to the charging roller 2, and the charging roller 2 uniformly charges the surface of the photosensitive drum 1 with a predetermined polarity (negative polarity in this embodiment) to a predetermined potential. The exposure device 3 has a laser diode that emits laser light, a collimator lens, a polygon mirror, and an fθ lens, for example. The exposure device 3 emits laser light L, which is turned on and off according to input image information (an image signal), and scans the surface of the photosensitive drum 1 uniformly charged by the charging roller 2 with the laser light L in a direction substantially perpendicular to the movement direction of the surface of the photosensitive drum 1 for exposure. By the exposure, the charge on the portion scanned with the laser light L is removed to form an electrostatic latent image (an electrostatic image) on the photosensitive drum 1.

The developing device 4 has a developing sleeve **4*a* serving as a rotatable developer bearing body (a developing member). In the interior (a hollow portion) of the developing sleeve 4*a*, a magnet roller serving as a magnetic field generating unit is arranged and fixed not to rotate. A magnetic toner particle (a toner) T serving as a developer is borne on the developing sleeve 4*a* in the form of a thin-layer coating, and conveyed to a developing location where the developing sleeve 4*a* and the photosensitive drum 1 are opposed to each other. A developing bias of the same polarity as the charging polarity for the photosensitive drum 1 (a developing voltage) is applied to the developing sleeve 4*a* by a developing power supply 22. This makes the toner T from the developing sleeve 4*a* adhere to the electrostatic latent image on the photosensitive member and be developed (made visible) to form a toner image on the photosensitive drum 1. In this embodiment, the toner charged with the same polarity (negative polarity in this embodiment) as the charging polarity for the photosensitive drum 1 adheres to an exposed portion (an image portion) of the photosensitive drum 1 in which the absolute value of the potential has been reduced by the uniform charging and the subsequent exposure to light (reversal developing). In this embodiment, the normal charging polarity for the toner (charging polarity at the time of developing) is the negative polarity. The transfer roller 5 comes into contact with the surface of the photosensitive drum 1 under a predetermined pressing force to form the transfer nip portion N. In addition, the transfer bias (transfer voltage) of the opposite polarity (positive polarity in this embodiment) to the normal charging polarity for the toner is applied to the transfer roller 5 by a transfer power supply 33. As a result, in the transfer nip portion N, the transfer roller 5 transfers the toner image on the photosensitive drum 1 onto the recording material P, such as a sheet of paper, held between and conveyed by the photosensitive drum 1 and the transfer roller 5. The transfer roller 5 is rotationally driven in a direction indicated by an arrow "b" in the drawing (clockwise direction). The fixing device 15 has a press roller 15***a* and a heating unit 15*b*. The fixing device 15 heats and presses the recording material P with the toner image transferred thereon between the press roller 15*a* and the heating unit 15*b*, thereby achieving fixing (fusion or sticking) of the toner image onto the recording material P. The cleaning device 6 removes and collects any toner (transfer residual toner) remaining on the photosensitive drum 1 after the transfer of the toner image or other unwanted substance from the photosensitive drum 1.

Operations of the components of the image forming apparatus 100 are controlled by the control device (DC controller) 30 provided in the image forming apparatus 100. The control device 30 makes the image forming apparatus 100 perform a job as described below, when an image forming signal is input from an external apparatus (not shown), such as a host computer (such as a personal computer), communicatively connected to the image forming apparatus 100, for example. Note that a job (an image forming operation, a print operation) is a series of operations for forming an image on one or more recording materials P and outputting the recording material(s), which is started in response to one start instruction.

Recording materials P in the sheet cassette 7 are fed out one by one by the sheet feed roller 8 and conveyed to the resist roller pair 10. In this process, the pre-feed sensor 9 detects the conveyance of the recording material P. Meanwhile, as described above, the photosensitive drum 1 is rotationally driven, and the charging process by the charging roller 2 and the scanning exposure by the exposure device 3 occur to reduce the absolute value of the potential of the portion of the photosensitive drum 1 irradiated with the laser light L, thereby forming the electrostatic latent image. The developing device 4 then develops the electrostatic latent image on the photosensitive drum 1, thereby forming the toner image on the photosensitive drum 1.

After the leading edge of the recording material P is detected by the top sensor 11, the recording material P is fed to the transfer nip portion N through the transfer guide 12 by the resist roller pair 10 in synchronization with the toner image on the photosensitive drum 1. The "leading edge of the recording material P" refers to the leading edge of the recording material P viewed in the conveyance direction of the recording material P, and the "trailing edge of the recording material P" refers to the trailing edge of the recording material P viewed in the conveyance direction of the recording material P. As described above, the toner image on the photosensitive drum 1 is then transferred to the recording material P in the transfer nip portion N. Static electricity on the recording material P with the toner image transferred thereon is minimized or eliminated by the antistatic needle 13, which is charged with the opposite polarity (negative polarity in this embodiment) to the transfer bias, and the recording material P is separated from the photosensitive drum 1 because of the resiliency or weight of the recording material P. The recording material P separated from the photosensitive drum 1 is conveyed to the fixing device 15 through the conveyance guide 14, and is discharged to the outside of the main unit of the image forming apparatus 100 by the sheet discharge roller pair 16 after the toner image is thermally fixed to the surface of the recording material P by the fixing device 15. Meanwhile, the transfer residual toner or other unwanted substance on the photosensitive drum 1 is removed and collected by the cleaning device 6.

2. Details of Configurations of Components

Next, details of configurations of the components of the image forming apparatus 100 according to this embodiment will be described.

(1) Photosensitive Drum

In this embodiment, the photosensitive drum 1 is an OPC photosensitive drum that has a diameter of 30 mm and includes an aluminum cylinder coated with an OPC layer. An outermost layer of the photosensitive drum 1 is a charge transport layer containing modified polycarbonate as a binder resin. The photosensitive drum 1 is an electrophotographic photosensitive member having a drum-like shape (a shape of a hollow cylinder). The photosensitive drum 1 is an image bearing body that bears the electrostatic latent image or toner image thereon.

(2) Charging Roller

In this embodiment, the charging roller 2 has a cylindrical conductive support body, a conductive elastic layer (an elastic base layer) formed on an outer circumference of the conductive support body, and a surface layer (an elastic surface layer) coating an outer circumference of the conductive elastic layer. The conductive elastic layer and the surface layer are both elastic layers. The conductive elastic layer is integrally formed on the outer circumference of the conductive support body in the shape of a concentric roller from a mixture of a conductive agent and an elastic polymer material. The conductive agent may be one of an ionically conductive agent and an electronically conductive agent, such as carbon black. The polymer elastic material may be one of epichlorohydrin rubber and acrylonitrile rubber, for example. The thickness of the conductive elastic layer is then adjusted by polishing, thereby providing a crowned conductive elastic layer having a thickness of 10 to 200 μm. In this embodiment, the crowning height is 100 μm. After the conductive elastic layer is formed, the surface layer is formed as a coating layer. In this embodiment, the surface layer contains a surface layer binder and a fine particle serving as a surface roughening agent. The fine particle has a mean volume diameter of 10 to 50 μm or preferably 20 to 40 μm, and can be any of a spherical particle and an irregularly shaped particle. The relative amount of the fine particle with respect to the surface layer binder is 10 to 100 wt %. The surface of the surface layer thus formed has a plurality of fine protrusions (projections). The fine protrusions provide the surface layer with irregularities.

The portion of the photosensitive drum 1 in the rotational direction thereof that is subjected to the charging process by the charging roller 2 is referred to as a charging location (charged portion). The charging roller 2 charges the photosensitive drum 1 with a discharge that occurs in at least one gap of the narrow gaps between the charging roller 2 and the photosensitive drum 1 formed on the upstream and downstream sides of the portion of contact between the charging roller 2 and the photosensitive drum 1 in the rotational direction of the photosensitive drum 1. For simplicity, however, the portion of contact between the charging roller 2 and the photosensitive drum 1 may be regarded as the charging location.

(3) Transfer Roller

Figure 2:
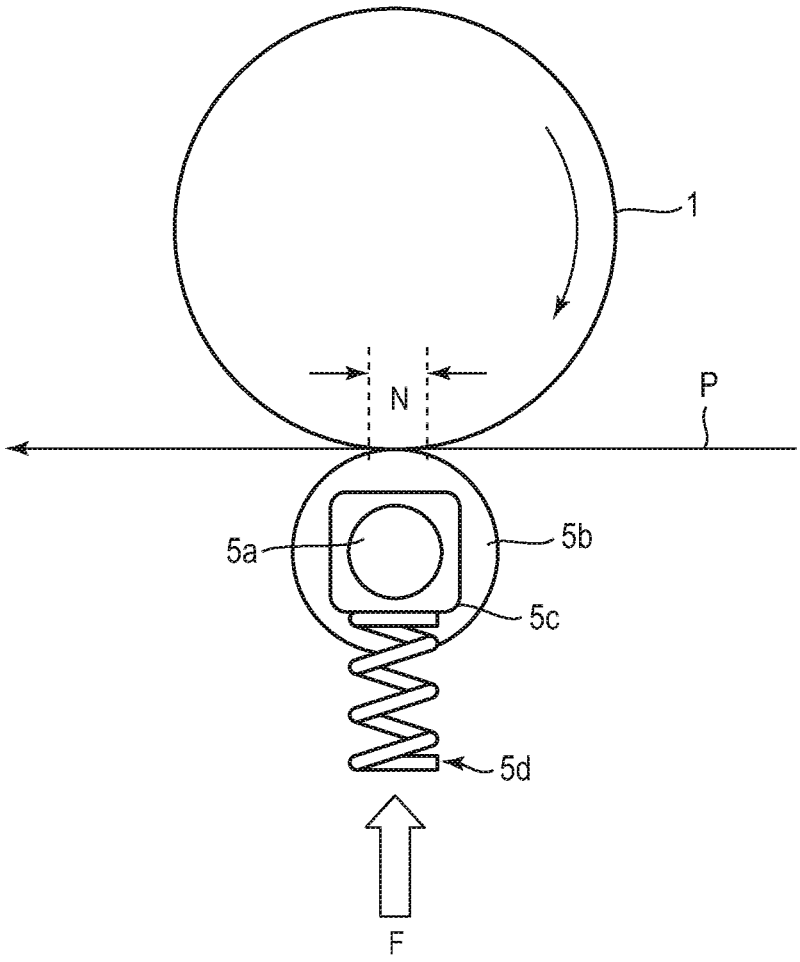
FIG. 2 is a schematic side view of around a transfer portion in a longitudinal direction.
Figure 3:
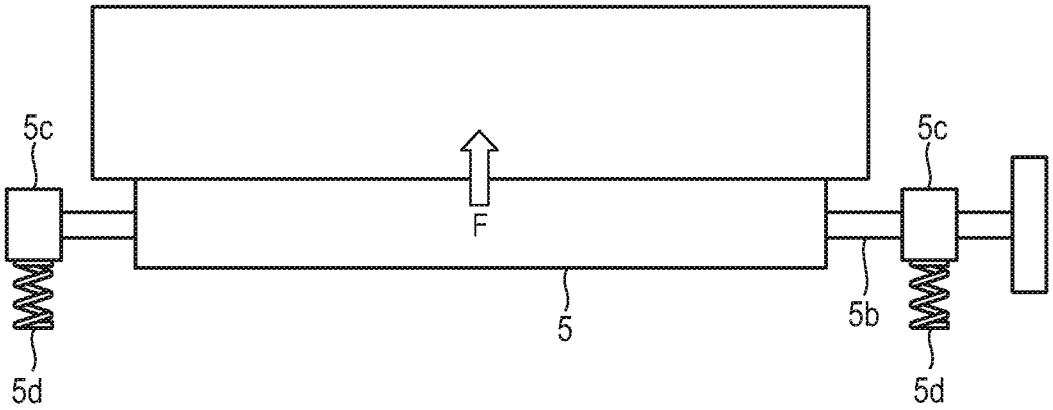
FIG. 3 is a schematic side view of the transfer portion and surroundings thereof viewed in a direction substantially perpendicular to the longitudinal direction.

FIG. 2 is a schematic side view of the transfer nip portion N and surroundings thereof viewed in the longitudinal direction of the photosensitive drum 1 (direction substantially perpendicular to the movement direction of the surface of the photosensitive drum 1 (direction of the rotational axis)). FIG. 3 is a schematic side view of the transfer nip portion N and surroundings thereof viewed in the direction substantially perpendicular to the longitudinal direction of the photosensitive drum 1.

The transfer roller 5 may be a rubber roller including a core metal 5*a* such as iron and steel use stainless (SUS) and an elastic layer 5*b* having a medium resistance formed on the core metal 5*a* that is made of a rubber such as ethylene propylene diene monomer (EPDM), silicone, nitrile butadiene rubber (NBR) and urethane and has one of a solid (substance-filled) structure and a foam sponge structure. The transfer roller 5 may have a hardness of 25 to 70 (in Asker-C under a load of 1 kg) and an electrical resistance of $10^6$ to $10^{10}\Omega$. The elastic layer 5*b* of the transfer roller 5 can have a desired outer diameter by performing primary vulcanization and then secondary vulcanization and then polishing the surface. In this embodiment, the transfer roller 5 includes a core metal 5*a* made of Fe having a diameter of 5 mm and an elastic layer 5*b* having a medium resistance on the core metal 5*a* that is made of an NBR-based ionically conductive sponge rubber having an electrical resistance of $1\times10^8\Omega$. In this embodiment, the transfer roller 5 is a sponge-type conductive, elastic roller having a hardness of 30 (in Asker-C under a total load of 1000 g), an outer diameter of 14.2 mm and a dimension of 218 mm in the longitudinal direction (direction substantially in parallel with the longitudinal direction of the photosensitive drum 1 (direction of the rotational axis)). In this embodiment, a press spring 5*d* serving as an urging unit urges the core metal 5*a* of the transfer roller 5 at the opposite ends thereof in the longitudinal direction via bearings 5*c*, thereby pressing the transfer roller 5 against the photosensitive drum 1 under a pressing force F to form the transfer nip portion N. In this embodiment, the transfer roller 5 is pressed against the photosensitive drum 1 under a total pressing force of 1.3 kilogram-force (Kgf).

Figure 4:
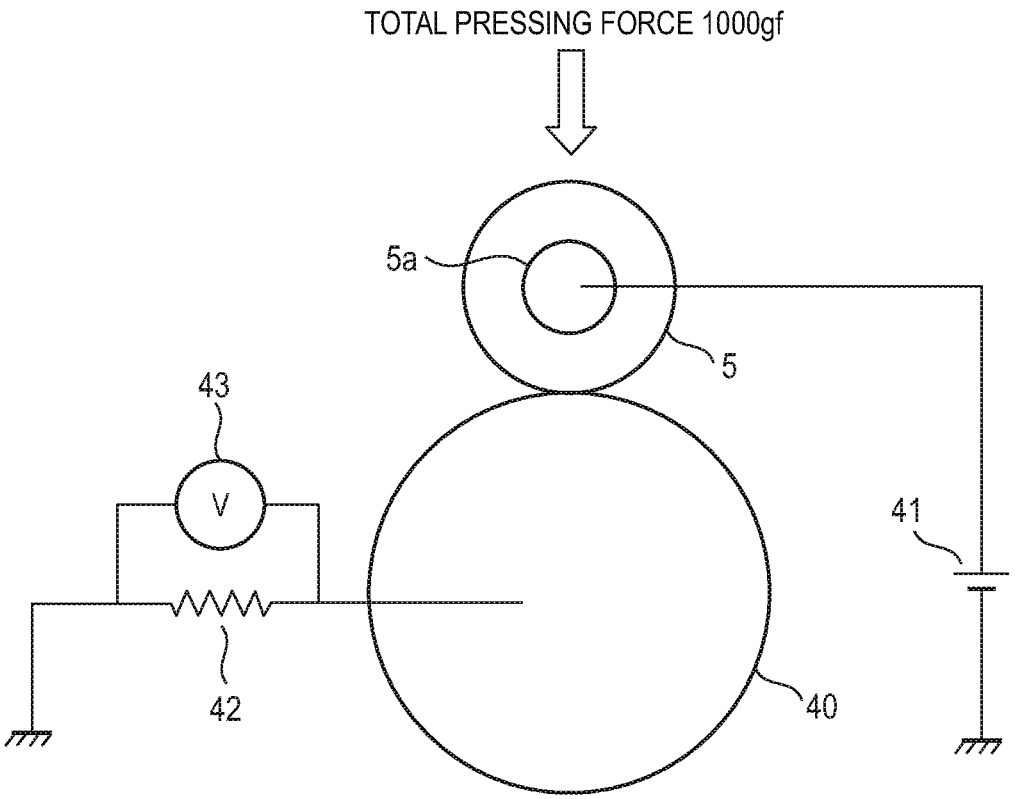
FIG. 4 is a schematic diagram for illustrating a method of measuring an electrical resistance of a transfer roller.

FIG. 4 is a schematic diagram for illustrating a method of measuring the electrical resistance of the transfer roller 5. As shown in FIG. 4, an aluminum cylinder 40 is rotated while the transfer roller 5 is made to abut against the aluminum cylinder 40 under a total pressing force of 100 gf (each is pressed under 500 gf), and an arbitrary voltage (+2.0 KV, for example) is applied to the core metal 5*a* by a direct-current high voltage power supply 41. At the same time, a voltmeter 43 reads the maximum value and minimum value of the voltage that occurs at the opposite ends of a resistor 42. From the read voltage values, an average value of the voltage applied to the circuit is determined, and the electrical resistance of the transfer roller 5 is calculated. The measurement is made at a temperature of 20° C. and a humidity of 60%.

3. Transfer Bias Control

Figure 5:
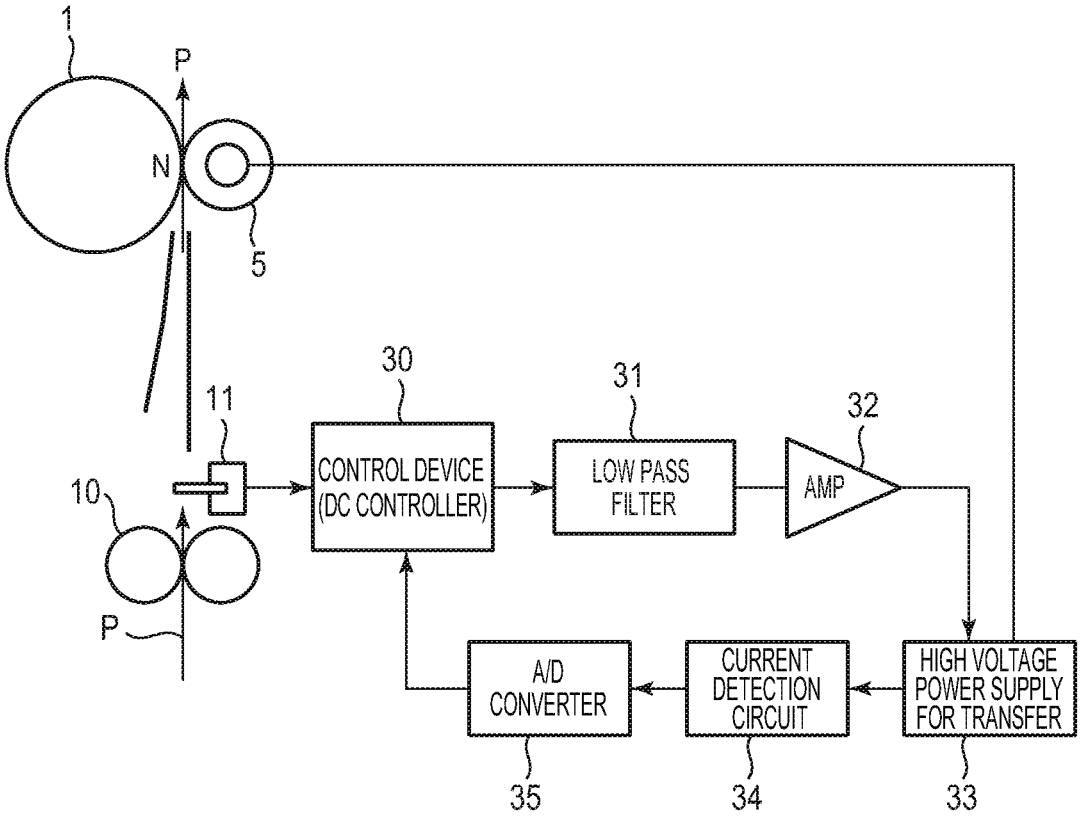
FIG. 5 is a block diagram for illustrating a transfer bias control.

FIG. 5 is a block diagram for illustrating a transfer bias control. With the image forming apparatus 100 according to this embodiment, the transfer bias control is achieved according to a programmable transfer voltage control (abbreviated as "PTVC", hereinafter) described below.

A passage signal for the recording material P conveyed to the transfer nip portion N is input from the top sensor 11 to the control device (DC controller) 30. The control device 30 then outputs a pulse width modulation (PWM) signal having a pulse width corresponding to a desired transfer output voltage to a low pass filter 31. The pulse width of the PWM signal is previously stored in the form of a transfer output table in a storage portion (an electronic memory in this embodiment) serving as a storage unit in the control device 30. The PWM signal is converted into DC by the low pass filter 31 and amplified by an amplifier (AMP) 32 to provide a transfer output voltage Vt, which is input to the transfer power supply (high voltage power supply for transfer) 33. The transfer power supply 33 applies a transfer bias (transfer voltage) Vtr to the transfer roller 5 based on the input transfer output voltage Vt. A current It that flows at the time of the application is detected by a current detection circuit 34 serving as a current detection unit, and a signal corresponding to the current It is input from the current detection circuit 34 to the control device 30 via an A/D converter 35.

In constant voltage control of the transfer bias Vtr, the control device 30 outputs a PWM signal having a pulse width corresponding to a desired voltage according to determination from a table showing the correspondence between the PWM signal and the transfer output voltage Vt previously set and stored in the storage portion of the control device 30. In constant voltage control of the transfer bias Vtr, in addition, the control device 30 continues gradually increasing the pulse width of the output PWM signal until the signal corresponding to the current It input to the control device 30 reaches a value corresponding to a predetermined current value (target current value). After that, the constant current control is performed by making the voltage (pulse width) follow any variation of the current value.

Figure 6:
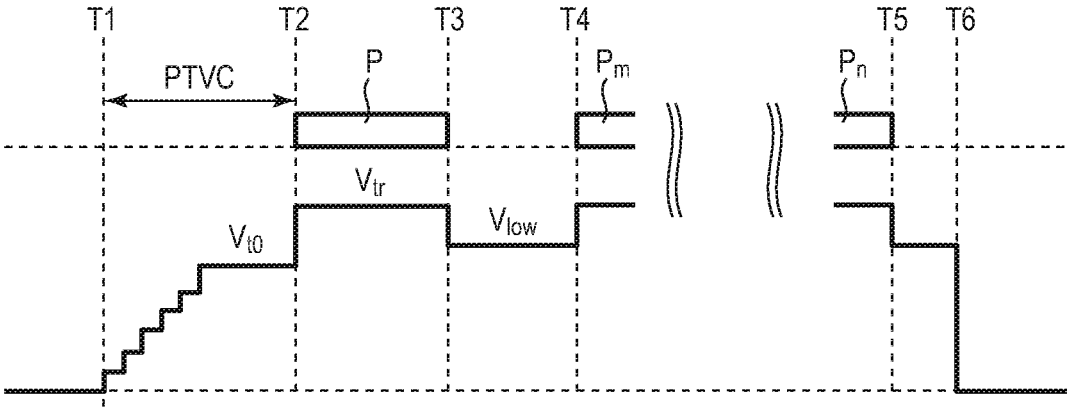
FIG. 6 is a chart for illustrating the transfer bias control.

FIG. 6 is a chart showing a transition of the transfer bias value for illustrating the transfer bias control in this embodiment. First, in response to receiving an image forming signal (a print signal, a job start signal) from an external apparatus, the control device 30 performs the transfer bias control as described below in a pre-rotation operation for a job. That is, starting at a time T1 when the charging process for uniformly charging the photosensitive drum 1 to a predetermined potential is completed, the control device 30 performs one PTVC detection with the photosensitive drum 1 and the transfer roller 5 abutting against each other. In the PTVC detection, the output voltage from the transfer power supply 33 is gradually increased, and a voltage Vto at the time when the transfer current reaches a preset predetermined current value is retained in the storage portion in the control device 30. Using the detected voltage Vto, the control device 30 determines the transfer bias Vtr that is to be applied for transfer according to the following transfer control formula (1), which is previously set and stored in the storage portion in the control device 30.

$$Vtr=\alpha*Vto+\beta \quad (1)$$

In the formula (1) above, Vto denotes a generated voltage that is generated when a predetermined detected current flows to the transfer roller 5 in PTVC detection, and α and β denote arbitrary constants determined by the arrangement involved with transfer (transfer system).

After determining the transfer bias Vtr, the control device 30 starts a print operation (exposure, developing) when preparation for image formation is completed, and then feeds the recording material P to the transfer nip portion N in synchronization with the toner image on the photosensitive drum 1. The control device 30 achieves the synchronization between the toner image on the photosensitive drum 1 and the recording material P based on timer counting started when the passage signal is input thereto in response to the recording material P passing through the top sensor 11. In this embodiment, the control device 30 applies the transfer bias Vtr determined as described above to the transfer roller 5 by constant voltage control for transfer at a time T2 when the leading edge of the recording material P reaches the transfer nip portion N. Furthermore, when receiving the passage signal in response to the trailing edge of the recording material P passing through the top sensor 11, the control device 30 starts timer counting again and calculates the time when the trailing edge of the recording material P reaches the transfer nip portion N. The control device 30 then switches the transfer bias Vtr to a low transfer bias (sheet interval bias) Vlow, which is applied between sheets of paper, at a time T3 when the trailing edge of the recording material P completely passes through the transfer nip portion N. The "sheet interval" refers the time (period) between the timing when the trailing edge of a leading recording material (the first recording material, for example) completely passes through the transfer nip portion N and the timing when the leading edge of the immediately following recording material P (the second recording material, for example) reaches the transfer nip portion N. For example, the distance between the top sensor 11 and the transfer nip portion N is denoted by D (mm), and the process speed is denoted by S (mm/sec). Then, the time t required for the trailing edge of the recording material P to reach the transfer nip portion N after passing through the top sensor 11 is determined according to t=D/S (sec). In order to switch the transfer bias to the low transfer bias at the time when the trailing edge of the recording material P completely passes through the transfer nip portion N, the transfer bias is switched to the low transfer bias D/S seconds after the trailing edge of the recording material P passes through the top sensor 11. The control device 30 then switches the low transfer bias Vlow back to the transfer bias Vtr at a time T4 when the leading edge of the immediately following recording material Pm reaches the transfer nip portion N after the sheet interval has elapsed. After that, if recording materials P are successively fed, the switching between the transfer bias Vtr and the low transfer bias Vlow continues occurring. The control device 30 switches the transfer bias Vtr to the low transfer bias Vlow at a time T5 when the trailing edge of the last recording material Pn completely passes through the transfer nip portion N, and then turns off the transfer bias at a predetermined time T6.

4. Transfer Memory

As described above, with the electrophotographic image forming apparatus, if a large size sheet having a relatively large width is fed immediately after a small size sheet having a relatively small width, an image failure (referred to as a "transfer memory", hereinafter), or specifically density unevenness, can occur in the image formed on the large size sheet.

With the image forming apparatus based on the reversal developing that uses a toner (negative toner) that is charged with the negative (minus) polarity, the charging unit uniformly charges the surface of the photosensitive member to a negative dark potential Vd. The exposure unit then applies light corresponding to the image density to the surface of the photosensitive member to produce a bright potential Vl, which has a smaller absolute value than Vd, thereby forming an electrostatic latent image of a contrast between Vd and Vl. In addition, a developing bias Vdc is applied to the developer bearing body. As a result, a developing contrast, which is the potential difference between Vdc and Vl, causes the toner to move from the developer bearing body to the Vl portion on the photosensitive member representing the electrostatic latent image to form a toner image on the photosensitive member. After that, the transfer bias Vtr of the positive (plus) polarity is applied to the transfer unit, thereby transferring the toner image on the photosensitive member from the photosensitive member to the sheet of paper. In this process, if the sheet fed is a small size sheet, more transfer current tends to flow in a non-sheet-passing region than in a sheet-passing region. This is because while the transfer bias Vtr applied to the transfer unit is constant in the direction of width of the sheet of paper, paper, which provides impedance, is present in the sheet-passing region and is not present in the non-sheet-passing region, for example. This will be further described below.

Figure 7:
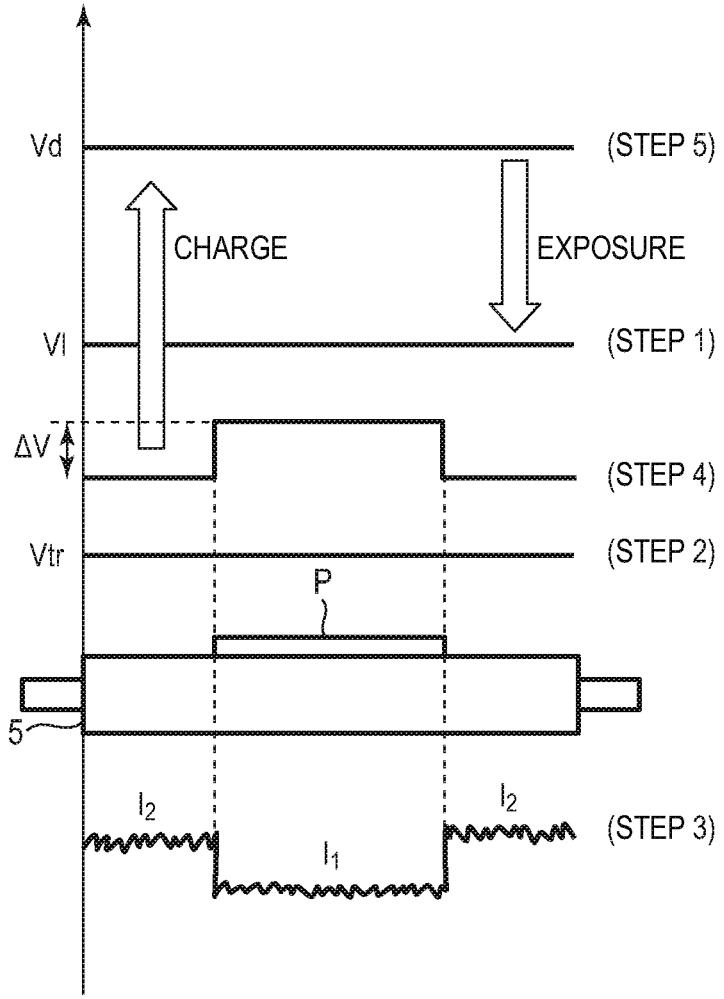
FIG. 7 is a schematic diagram for illustrating a transfer memory.

FIG. 7 is a schematic diagram showing variations of the surface potential of the photosensitive drum 1 when an A5-size recording material P is fed as a small size sheet. Note that, in this embodiment, a recording material P of any size is conveyed with the center thereof in the direction substantially perpendicular to the conveyance direction thereof substantially aligned with the center of the photosensitive drum 1 in the longitudinal direction thereof (center-referenced conveyance).

First, when a job is started, the dark potential Vd is produced on the surface of the photosensitive drum 1 by the charging process, and then the bright potential ("pre-transfer potential") Vl is produced by exposure by the exposure device 3 (Step 1). After that, the A5-size recording material P is fed to the transfer nip portion N. Then, the transfer bias Vtr is applied to the transfer roller 5 uniformly in the longitudinal direction thereof (the width direction of the recording material P) in a period from the time when the leading edge of the recording material P reaches the transfer nip portion N to the time when the trailing edge of the recording material P completely passes through the transfer nip portion N (Step 2). In this process, the transfer current that flows to the transfer nip portion N is affected by the impedance of the recording material P, and a current I2 flowing through the non-sheet-passing region is higher than a current I1 flowing through the sheet-passing region (Step 3). Because of the difference between the currents I1 and I2, a larger amount of positive charges moves onto the photosensitive drum 1 in the non-sheet-passing region than in the sheet-passing region. As a result, a "post-transfer potential", which is the surface potential of the photosensitive drum 1 before the charging process after the photosensitive drum 1 passes through the transfer nip portion N, can be uneven in the longitudinal direction of the photosensitive drum 1 (the width direction of the recording material P). That is, the surface potential of the photosensitive drum 1 can have an uneven distribution in which the potential is shifted by ΔV to the positive side in the non-sheet-passing region compared with in the sheet-passing region (Step 4). However, if the amount of positive charges that has moved to the photosensitive drum 1 is minute, the unevenness of the surface potential of the photosensitive drum 1 is minimized or eliminated by the charging process for the portion of the photosensitive drum 1 downstream of the transfer nip portion N in the rotational direction of the photosensitive drum 1 (Step 5).

Figure 8:
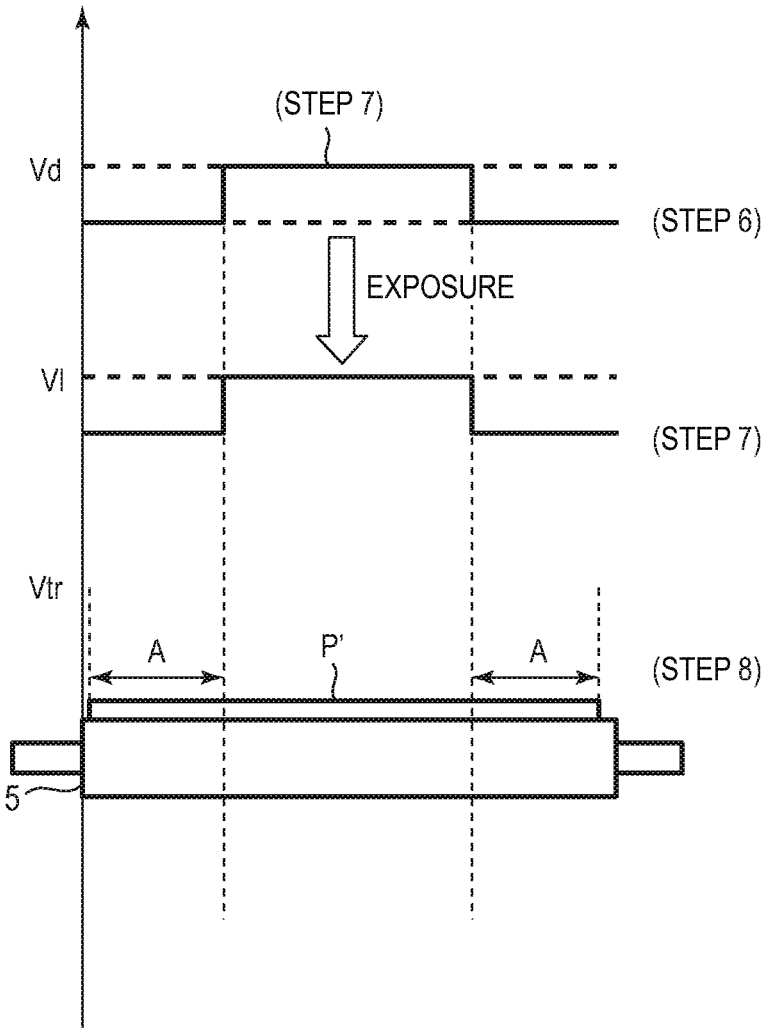
FIG. 8 is a schematic diagram for illustrating the transfer memory.

FIG. 8 is a schematic diagram showing variations of the surface potential of the photosensitive drum 1 when a relatively large number of A5-size recording materials P is successively fed as small size sheets. As in the case shown in FIG. 7, each time the A5-size recording material P passes through the transfer nip portion N, a larger amount of positive charges moves onto the photosensitive drum 1 in the non-sheet-passing region than in the sheet-passing region. When the amount of charges moving onto the photosensitive drum 1 exceeds a predetermined amount, the unevenness of the surface potential of the photosensitive drum 1 may not be eliminated even after the charging process, because the photosensitive layer forming the surface of the photosensitive drum 1 has a limited mobility of the positive charge (Step 6). In this condition, if an LTR-size recording material P' is immediately fed as a large size sheet having a wider width than the A5-size recording material P, for example, the bright potential ("pre-transfer potential") Vl produced by the exposure by the exposure device 3 remains uneven in the longitudinal direction of the photosensitive drum 1 (Step 7). As a result, a "transfer memory", which involves an increase of density of the image, occurs at the edges of the LTR-size recording material P' in the width direction and in a region A, which corresponds to the non-sheet-passing region for the preceding small size sheet P (Step 8). As described above, in the non-sheet-passing region, the absolute value of Vl is smaller than in the sheet-passing region, the developing contrast, which is the potential difference between Vdc and Vl, is greater than in the sheet-passing region, and the amount of toner that moves to the Vl portion is greater than in the sheet-passing region. This appears as a density unevenness of the image formed on the large size sheet immediately following the small size sheet. That is, at the edges of the large size sheet in the width direction thereof, the image has an increased density in a portion corresponding to the non-sheet-passing region for the preceding small size sheet.

5. Reduction of Transfer Memory

In this embodiment, the image forming apparatus 100 can change the sheet passing interval (sheet interval) between the small size sheet and the immediately following large size sheet based on predetermined information used for determination of the ease of occurrence of a transfer memory (hereinafter referred to also as "transfer memory determination information"). In this embodiment, the image forming apparatus 100 changes the sheet passing interval by changing the sheet feeding interval from the resist roller pair 10. In changing the sheet passing interval between the small size sheet and the immediately following large size sheet, the timing of formation of the image to be transferred onto the large size sheet and the subsequent recording materials P is also changed. In this embodiment, the image forming apparatus 100 can perform a first mode in which the sheet passing interval between the small size sheet and the immediately following large size sheet is a first interval and a second mode in which the sheet passing interval is a second interval greater than the first interval. In this embodiment, the first interval is a time less than the time required for one rotation of the photosensitive drum 1, and the second interval is equal to or longer than the time required for one rotation of the photosensitive drum 1. That is, in this embodiment, when it is determined that a transfer memory is likely to occur based on the transfer memory determination information, the second mode is selected, and the sheet passing interval is extended to be equal to or longer than the time required for one rotation of the photosensitive drum 1. In this way, the surface of the photosensitive drum 1 on which an image to be transferred onto the large size sheet fed immediately following the small size sheet is to be formed can be subjected to a plurality of charging processes in the extended sheet passing interval. In other words, the potential distribution of the photosensitive drum 1 can be made even in the longitudinal direction of the photosensitive drum 1 before starting the formation of the image to be transferred onto the large size sheet to be fed immediately following the small size sheet. Therefore, occurrence of a density unevenness of the image formed on the large size sheet fed immediately following the small size sheet caused by the transfer memory can be reduced.

Cases where the large size sheet is fed immediately following the small size sheet are as follows. In a case, for example, a single job involves a mixture of small size sheets and large size sheets as the recording materials P on which images are to be formed and forming an image on the large size sheet immediately following the small size sheet. In another case, the image forming apparatus can receive reservation of a plurality of jobs, a job for a large size sheet is reserved immediately following a job for a small size sheet, and a preparation operation of performing the charging process is omitted for a plurality of rotations of the photosensitive drum 1.

The first interval may be the same as or different from the sheet passing interval between a plurality of small size sheets immediately preceding the large size sheet (although typically the same).

The second interval can be arbitrarily set to adequately reduce the transfer memory as far as the second interval is equal to or longer than the time required for one rotation of the photosensitive drum 1. According to the investigation by the inventor, however, a time equal to or less than the time required for ten rotations of the photosensitive drum 1 at most would be sufficient as the second interval. From the viewpoint of preventing the decrease of the productivity of image formation and the wear of members, the number of rotations of the photosensitive drum 1 should be minimized as far as the transfer memory can be adequately reduced.

Furthermore, when a plurality of large size sheets is fed, if the sheet passing interval between the small size sheet and the large size sheet immediately following the small size sheet (the first large size sheet) is set to the second interval, the following measure is typically taken. That is, the sheet passing interval between the first large size sheet and the following large size sheets is changed to a third interval smaller than the second interval. The third interval is typically less than the time required for one rotation of the photosensitive drum 1. The third interval may be the same as or different from the first interval (although typically the same).

As described above, if the sheet passing interval is always extended when a large size sheet is fed immediately following a small size sheet, the productivity of the image formation may unnecessarily decrease, and wear of the photosensitive drum or other members may be accelerated to reduce the service life of those members.

According to this embodiment, however, the control device 30 selects the first mode described above if the control device 30 determines that the transfer memory is at an allowable level based on the transfer memory determination information, and selects the second mode described above if the control device 30 determines that the transfer memory is not at the allowable level. In other words, according to this embodiment, the optimal shortest sheet passing interval that causes no transfer memory can be set based on the transfer memory determination information. As a result, the productivity of image formation can be prevented from unnecessarily decreasing, and excessive rotations of the photosensitive drum 1, which may cause acceleration of wear of the photosensitive drum 1 and other members and reduction of the service life of those members, can be avoided.

The transfer memory determination information may be information such as the time required for the small size sheet to pass through the transfer nip portion N (sheet feed time), the electrical resistance of the transfer roller 5, the electrical resistance of the small size sheet, and the printing ratioprinting ratio of the image formed on the small size sheet. In this embodiment, a case where the information on the sheet feed time of the small size sheet is used as the transfer memory determination information will be described, for example. Other examples of the transfer memory determination information will be described later with regard to other embodiments.

Note that the sizes of the small size sheet and the large size sheet following the small size sheet to which a control for changing the sheet passing interval (sheet passing interval change control) is applied are not particularly limited. The small size sheet can be a recording material P having a first width in the direction substantially perpendicular to the conveyance direction thereof, and the large size sheet following the small size sheet can be a recording material P having a width greater than the first width in the direction substantially perpendicular to the conveyance direction thereof. That is, the first width is smaller than the width (maximum width) of the recording material P having the greatest width in the direction substantially perpendicular to the conveyance direction thereof of the recording materials P that can be fed in the image forming apparatus 100. The second width is greater than the first width. Alternatively, the first width may be smaller than a first predetermined value, the second width is greater than a second predetermined value, and the second predetermined value may be greater than the first predetermined value. For example, the sheet passing interval change control may be applied only when immediately following a predetermined small size sheet, a predetermined large size sheet is fed which has a width greater than the width of the predetermined small size sheet by a predetermined value or more. In that case, for other combinations of small size sheets and large size sheets, the sheet passing interval between the small size sheet and the immediately following large size sheet can be set to be constant (that is, the control of changing the sheet passing interval based on the transfer memory determination information is not performed).

6. Sheet Passing Interval Change Control

Figure 9:
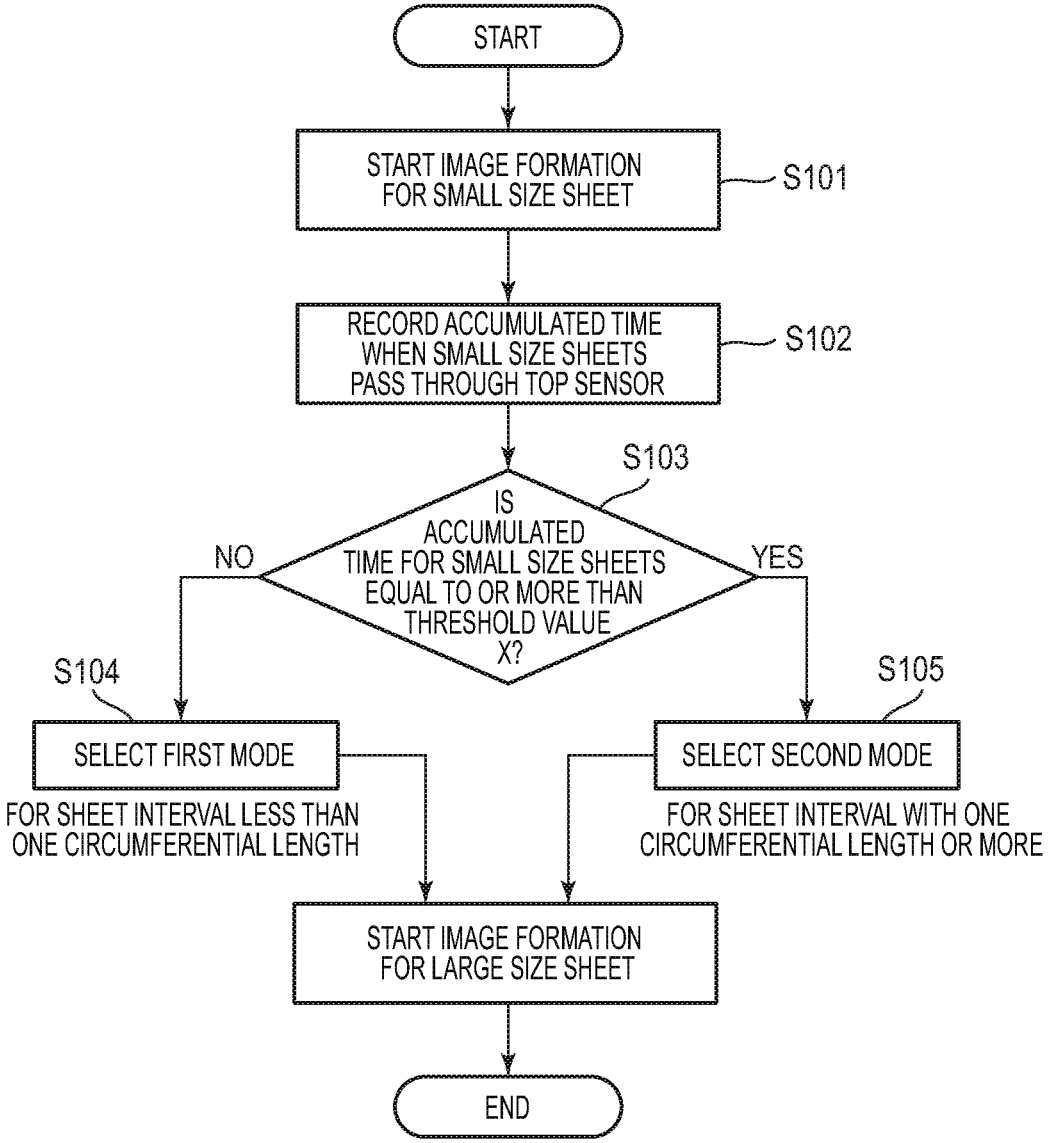
FIG. 9 is a flowchart showing a control according to an embodiment 1.

FIG. 9 is a flowchart showing an operation flow of the sheet passing interval change control. In this embodiment, based on an accumulated time, which is the accumulation value of the sheet feed times of small size sheets, the sheet passing interval between the last small size sheet and the immediately following large size sheet is controlled. This control is performed by the control device 30 based on a program, data (a threshold, for example) stored in the storage portion of the control device 30. In this section, a case where a job for successively forming images on small size sheets and then on large size sheets is performed will be described as an example. The control device 30 can recognize the size of the recording material P on which an image is to be formed, based on information about setting of the type of the recording material P included in job information input from an external apparatus. The control device 30 can automatically select one of recording materials P of different sizes contained in a plurality of recording material container portion of the image forming apparatus 100, and feed the selected recording material P. FIG. 9 shows an operation flow focused on changing the sheet passing interval, and other many processes typically required when performing the job are omitted. The prefix "S" of "S101" or the like in FIG. 9 means "step" (the same holds true for FIGS. 11, 14 and 17 described later).

First, the control device 30 starts a job and starts image formation on a small size sheet (S101). The control device 30 measures the time required for the small size sheet passes through the top sensor 11 by timer counting, and records the accumulated time in the storage portion of the control device 30 to constantly update the content of the storage portion (S102). The time required for the small size sheet to pass through the top sensor 11 corresponds to the sheet feed time, which is the time required for the small size sheet to pass through the transfer nip portion N. Before feeding of the small size sheets is completed (that is, before supply of large size sheets to the transfer nip portion N is started), the control device 30 then determines whether or not the latest accumulated time is equal to or more than a predetermined threshold X (S103). The threshold X is a boundary value used for determining whether a transfer memory occurs or not. The threshold X can be a value previously set so that an image failure due to a transfer memory that is not allowable is prevented from occurring on the large size sheet immediately following the last small size sheet even under a condition where the transfer memory is likely to occur. In this embodiment, as a condition where the transfer memory is likely to occur, a case is assumed where an image is formed on a small size sheet having a relatively high electrical resistance with a relatively high printing ratioprinting ratio in a high-temperature and high-humidity circumstance. In the following, the high-temperature and high-humidity circumstance will be referred to also as an "HH circumstance".

If it is determined in S103 that the accumulated time is less than the threshold X, the control device 30 then determines to perform feeding of the large size sheets in the first mode in which the sheet passing interval between the last small size sheet and the first large size sheet is shorter than the time required for one rotation of the photosensitive drum 1 (S104). On the other hand, if it is determined in S103 that the accumulated time is equal to or more than the threshold X, the control device 30 determines to perform feeding of the large size sheets in the second mode in which the sheet passing interval between the last small size sheet and the first large size sheet is equal to or longer than the time required for one rotation of the photosensitive drum 1 (S105). After that, the control device 30 perform feeding of the large size sheet immediately following the last small size sheet in the mode determined in one of S104 and S105, and starts image formation on the large size sheet (S106).

According to the operation flow described above, after a large amount of small size sheets are successively fed, for example, occurrence of the transfer memory can be reduced by starting feeding of large size sheets after a sheet passing interval equal to or longer than the time required for one rotation of the photosensitive drum 1. On the other hand, after a relatively small amount of small size sheet are successively fed, for example, feeding of large size sheets can be immediately started after a sheet passing interval less than the time required for one rotation of the photosensitive drum 1.

In this embodiment, the sheet passing interval in the second mode is set to the time required for one rotation of the photosensitive drum 1. However, the sheet passing interval is not limited to the time required for one rotation of the photosensitive drum 1. Furthermore, the sheet passing interval is not limited to a fixed value, such as the time required for one rotation of the photosensitive drum 1, but can vary depending on the information on the accumulated time, for example, and can be set to the time required for two or three rotations of the photosensitive drum 1, for example. In other words, when the sheet passing interval is set to the second interval (which is equal to or longer than the time required for one rotation of the photosensitive drum 1), the second interval can be changed based on the transfer memory determination information. In that case, the sheet passing interval can be longer in the case where the accumulated time is a second time, which is longer than a first time, than in the case where the accumulated time is the first time.

7. Verification of Effect

Next, a result of verification of the effect of the sheet passing interval change control according to this embodiment will be described. In this example, immediately after A5-size sheets as small size sheets are successively fed, LTR-size sheets as large size sheets are fed.

In this embodiment, the threshold X is set to prevent a transfer memory from occurring on the first large size sheet even after images having a relatively high printing ratio of about 75% are successively formed on A5-size sheets having a moisture content of about 4% and a relatively high electrical resistance in an HH circumstance in which the temperature is 30° C. and the humidity is 85%. More specifically, in this embodiment, the threshold X is set to the time required for 50 A5-size recording materials P to pass through the transfer nip portion N (top sensor 11).

As shown in Table 1, in this embodiment, based on the determination of whether or not the accumulated time is equal to or more than the predetermined threshold X, the first mode is selected if the number of A5-size sheets successively fed before feeding of the large size sheets is up to 50. On the other hand, if the number of A5-size sheets successively fed before feeding of the large size sheets is equal to or more than 51, the second mode is selected. If a B5-size sheet or an EXE sheet is fed as a small size sheet, such sheets have a greater longitudinal dimension (in the conveyance direction) than the A5-size sheet, the accumulated time for each sheet is longer. Therefore, the number of sheets fed until the accumulated time reaches the predetermined threshold X decreases, and the shift from the first mode to the second shift occurs when the number of small size sheets fed is less than 51.

TABLE 1

| | Number of successive A5-size sheets as small size sheets | |
|---|---|---|
| | 1 to 50 | Equal to or more than 51 |
| This embodiment | Sheet interval: less than time required for one rotation of drum (first mode) | Sheet interval: equal to or longer than time required for one rotation of drum (second mode) |
| Comparative Example | Sheet interval: equal to or longer than time required for one rotation of drum (no mode setting) | Sheet interval: equal to or longer than time required for one rotation of drum (no mode setting) |

In this embodiment, even under the above-described condition that images having a relatively high printing ratio of about 75% are successively formed on A5-size sheets having a moisture content of about 4% and a relatively high electrical resistance in an HH circumstance in which the temperature is 30° C. and the humidity is 85%, no transfer memory occurs on the large size sheet regardless of the number of small size sheets fed. As can be seen, according to this embodiment, by avoiding unnecessarily extending the sheet passing interval, occurrence of the transfer memory can be reduced while preventing the productivity of image formation from unnecessarily decreasing and the service life of the photosensitive drum 1 and other members from being reduced.

On the other hand, in the Comparative Example, as shown in Table 1, the sheet passing interval between the last small size sheet and the first large size sheet is fixed at the time equal to or longer than the time required for one rotation of the photosensitive drum 1 (the time equal to the time required for one rotation of the photosensitive drum 1, in this example). In the Comparative Example, no transfer memory occurs on the first large size sheet, regardless of the number of small size sheets fed. In the Comparative Example, however, the sheet passing interval between the last small size sheet and the first large size sheet is constantly long, and therefore, the sheet passing interval is unnecessarily long if the number of small size sheets successively fed is small. Therefore, the productivity of image formation may unnecessarily decrease, and the service life of the photosensitive drum 1 and other members may be reduced.

As described above, according to this embodiment, when successively forming an image on a first recording material (small size sheet) P having a first width in the direction substantially perpendicular to the movement direction of the surface of the photosensitive member 1 and a second recording material (large size sheet) P having a second width greater than the first width conveyed following the first recording material P to the transfer portion, the control unit 30 can change the interval (sheet passing interval) between the time when the trailing edge of the first recording material P in the conveyance direction completely passes through the transfer portion N and the time when the leading edge of the second recording material P conveyed immediately following the first recording material P to the transfer portion N reaches the transfer portion to one of the first interval, which is the time less than the time required for one rotation of the photosensitive member 1, and the second interval, which is the time equal to or longer than the time required for one rotation of the photosensitive member 1, based on predetermined information (transfer memory determination information) concerning the transfer onto the first recording material P. According to this embodiment, the control unit 30 uses passage time on the time required for the first recording material P to pass through the transfer portion N as the transfer memory determination information. The control unit 30 performs control to set the sheet passing interval to the first interval if the time indicated by the passage time is the first time, and set the sheet passing interval to the second interval if the time indicated by the passage time is the second time greater than the first time. In particular, according to this embodiment, the control unit 30 sets the sheet passing interval to the first interval if the time indicated by the passage time is less than a predetermined threshold, and sets the sheet passing interval to the second interval if the time indicated by the passage time is equal to or more than the threshold.

As described above, according to this embodiment, occurrence of a transfer memory occurring on a large size sheet when the large size sheet is fed immediately following a small size sheet can be reduced while preventing the decrease of the productivity of image formation and the reduction of the service life of members.

Embodiment 2

Next, another embodiment of the present disclosure will be described. A basic configuration and an operation of an image forming apparatus according to this embodiment is the same as those of the image forming apparatus according to the embodiment 1. Therefore, components of the image forming apparatus according to this embodiment that have the same functions as, or functions corresponding to those of the image forming apparatus according to the embodiment 1 are denoted by the same reference numerals as those in the embodiment 1, and detailed descriptions thereof will be omitted (the same holds true for other embodiments described later).

In this embodiment, as the transfer memory determination information, information on the electrical resistance of the transfer roller 5 and information on the sheet feed time of the small size sheet are used.

Figure 10:
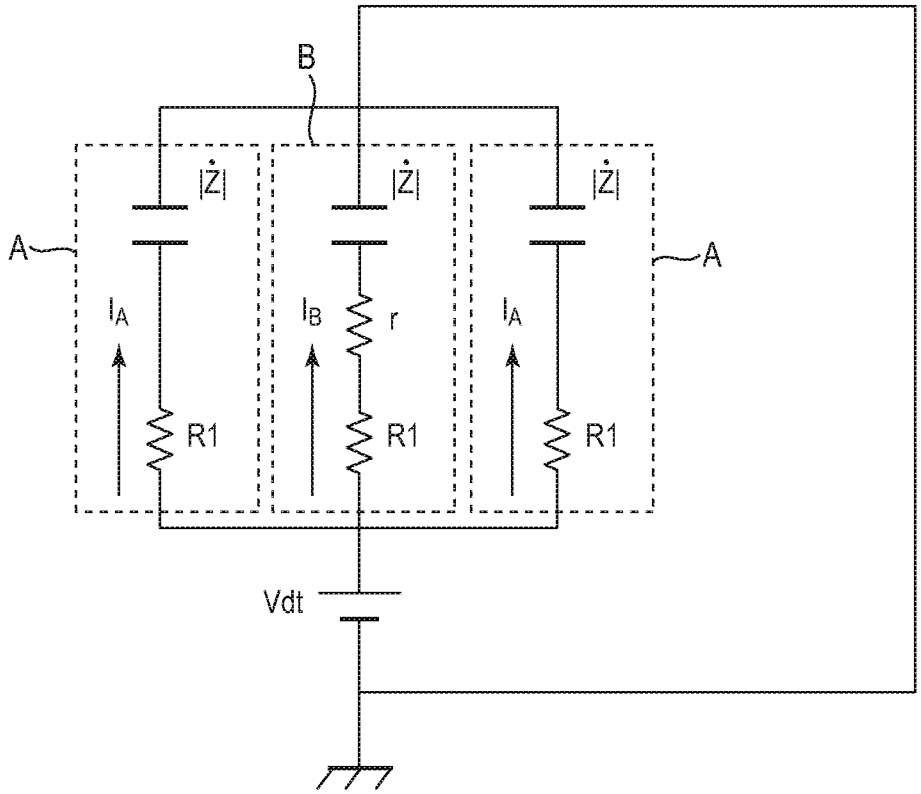
FIG. 10 is a schematic diagram showing an electrical resistance relationship between a sheet-passing region and a non-sheet-passing region in a transfer nip portion.

FIG. 10 is a schematic diagram showing an electrical resistance relationship between the sheet-passing region and the non-sheet-passing region in the transfer nip portion N during feeding of a small size sheet in the absence of toner. As shown in FIG. 10, a cross section of the transfer nip portion N (a cross section taken along the longitudinal direction of the transfer nip portion N) is schematically divided into non-sheet-passing regions A and a sheet-passing region B. A resistance R1 represents a divisional resistance of the transfer roller 5 in the non-sheet-passing regions A and the sheet-passing region B. A resistance r represents an electrical resistance of the small size sheet held by the transfer nip portion N. A voltage Vdt represents a potential contrast that is the potential difference Vd−Vtr between the transfer bias Vtr applied to the transfer roller 5 during sheet feeding and the potential Vd of a non-image formation region (non-print region) of the photosensitive drum 1. An impedance Zi represents an impedance of the photosensitive drum 1 opposed to the transfer roller 5 and is expressed as 1/ωC using an angular frequency ω and a capacitance C of the photosensitive drum 1. A current $I_A$ represents a transfer current flowing to the non-sheet-passing regions A and is expressed as Vdt/(R1+1/ωC) according to a relationship between the voltage Vdt, the resistance R1 and the impedance Zi. A current $I_B$ is a transfer current flowing to the sheet-passing region B and is expressed as Vdt/(R1+r+1/ωC) according to a relationship between the voltage Vdt and a combined resistance of the resistances R1 and r and the impedance Zi. A region of any of the photosensitive drum 1 and the recording material P in which the toner image can be formed is referred to as an "image formation region (print region)", and a region outside the image formation region is referred to as the "non-image formation region (non-print region)".

The transfer memory caused by feeding of a small size sheet depends on the ratio of the transfer current in the non-sheet-passing region A to the transfer current in the sheet-passing region B and is expressed by the following formula (2).

$$I_A/I_B = Vdt/(R1+1/\omega C)/(Vdt/(R1+r+1/\omega C)) = 1+r/(R1+1/\omega C) \quad (2)$$

As can be seen from the above formula (2), the transfer current ratio ($I_A/I_B$) is affected by the electrical resistance R1 of the transfer roller 5 during feeding of a small size sheet and decreases as the electrical resistance R1 of the transfer roller 5 increases. In other words, the lower the electrical resistance of the transfer roller 5 is, the more likely the transfer memory is to occur.

In view of this, in this embodiment, the electrical resistance R1 of the transfer roller 5 during feeding of a small size sheet is estimated, and the threshold X of the accumulated time described above with regard to the embodiment 1 is switched based on the estimated value of the electrical resistance (which is referred to as an "estimated roller resistance value" herein). In this way, based on the information on the electrical resistance of the transfer roller 5 and the information on the sheet feed time of the small size sheet used as the transfer memory determination information, the sheet passing interval between the last small size sheet and the first large size sheet is controlled. The estimated roller resistance value is not limited to the electrical resistance itself but can be any index value correlated with the electrical resistance, such as a voltage value and a current value.

In this embodiment, the electrical resistance of the transfer roller 5 is estimated by the PTVC detection described above with regard to the embodiment 1. Specifically, the control device 30 gradually increases the output voltage of the transfer power supply 33 during the pre-rotation operation for the job. The control device 30 then stores a voltage value Vt0 at the time when the transfer current flowing from the transfer roller 5 to the photosensitive drum 1 reaches a preset predetermined current value (18.0 μA, for example) in the storage portion in the control device 30. In this embodiment, the detected voltage value Vt0 is used as the estimated roller resistance value. Alternatively, an electrical resistance value determined from the current value and voltage value described above may be used as the estimated roller resistance value.

Figure 11:
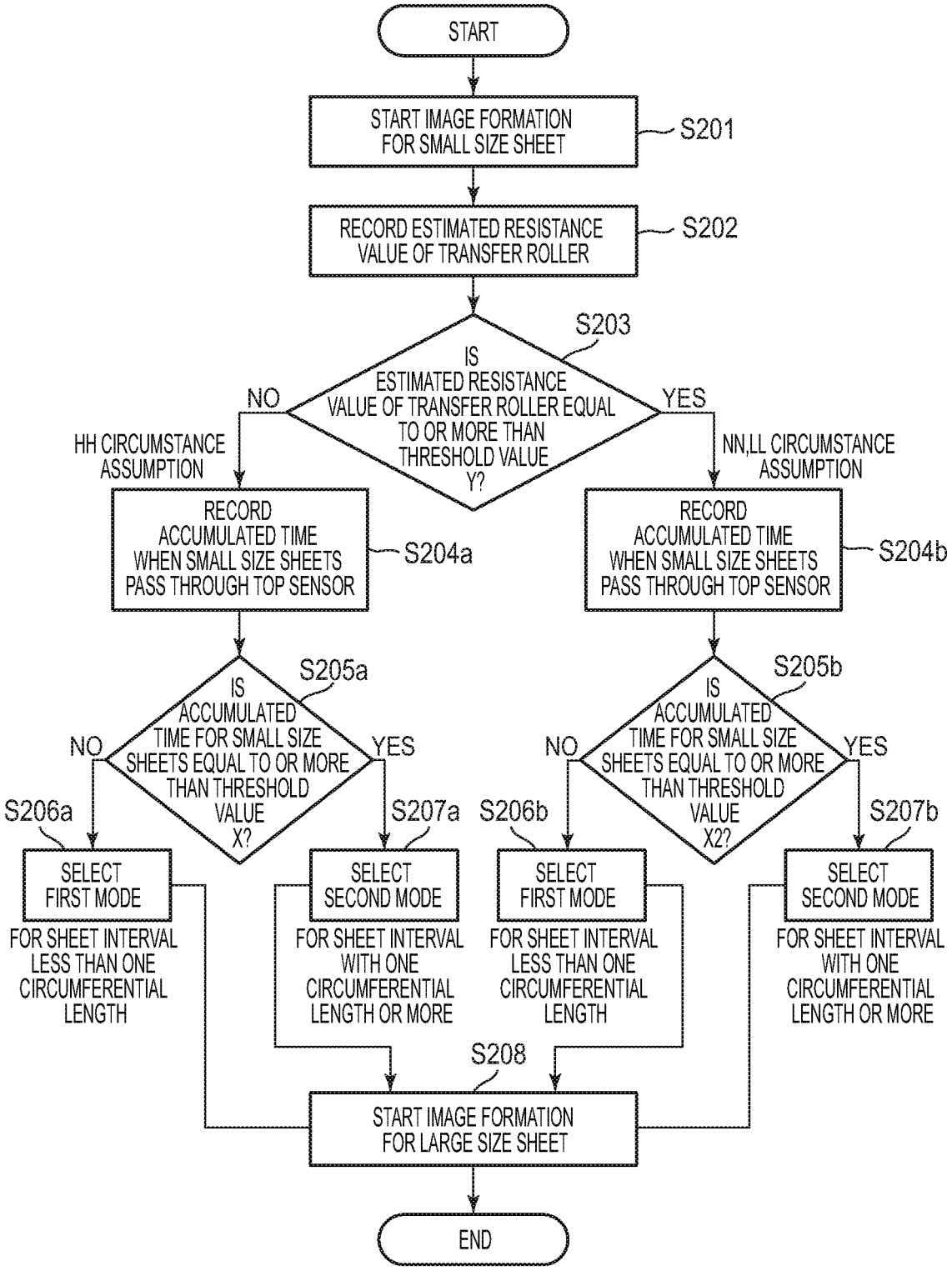
FIG. 11 is a flowchart showing a control according to an embodiment 2.

FIG. 11 is a flowchart showing an operation flow of a sheet passing interval change control according to this embodiment. According to this embodiment, based on the accumulated time, which is the accumulation value of the sheet feed times of small size sheets, and the estimated roller resistance value, the sheet passing interval between the last small size sheet and the immediately following large size sheet is controlled. This control is performed by the control device 30 according to a program, data (threshold) and the like stored in the storage portion in the control device 30. FIG. 11 shows an operation flow focused on changing the sheet passing interval, and many other processes typically required for performing the job are omitted in the drawing.

First, the control device 30 starts a job and starts image formation on small size sheets (S201), and then records the estimated roller resistance value obtained by the PTVC detection during the pre-rotation operation in the storage portion in the control device 30 (S202). The control device 30 then determines whether or not the estimated roller resistance value is equal to or more than a predetermined threshold Y (S203).

Next, a case will be described where, in S203, the control device 30 determines that the estimated roller resistance value is not equal to or more than the threshold Y (that is, less than the threshold Y). In this embodiment, as described later, the case where the estimated roller resistance value is less than the threshold Y is a case of the HH circumstance. The control device 30 measures the time required for the small size sheet to pass through the top sensor 11 by timer counting, and records the accumulated time in the storage portion in the control device 30 to constantly update the content of the storage portion (S204*a*). The control device 30 then determines whether or not the latest accumulated time is equal to or more than a predetermined threshold X before feeding of the small size sheets is completed (that is, before supply of the large size sheets to the transfer nip portion N is started) (S205*a*). After that, the control device 30 performs processing of S206*a*, S207*a* and S208, which are the same as those of S104, S105 and S106 shown in FIG. 9 described above with regard to the embodiment 1, respectively. That is, if the accumulated time is less than the threshold X, the first mode (in which the sheet passing interval is less than the time required for one rotation of the photosensitive drum 1) is selected, and if the accumulated time is equal to or more than the threshold X, the second mode (in which the sheet passing interval is equal to or longer than the time required for one rotation of the photosensitive drum 1) is selected.

Next, a case will be described where, in S203, the control device 30 determines that the estimated roller resistance value is equal to or more than the threshold Y. In this embodiment, as described later, the case where the estimated roller resistance value is equal to or more than the threshold Y is a case of any of a low-temperature and low-humidity circumstance and a normal-temperature and normal-humidity circumstance. In this case, the control device 30 performs processing of S204*b*, S205*b*, S206*b*, S207*b* and S208, which are similar to those of S204*a*, S205*a*, S206*a*, S207*a* and S208 described above, respectively. However, in S205*b*, the control device 30 determines whether or not the accumulated time is equal to or more than a predetermined threshold X2 (>X). That is, if the accumulated time is less than the threshold X2, the first mode (in which the sheet passing interval is less than the time required for one rotation of the photosensitive drum 1) is selected, and if the accumulated time is equal to or more than the threshold X2, the second mode (in which the sheet passing interval is equal to or longer than the time required for one rotation of the photosensitive drum 1) is selected.

The threshold Y is a boundary value for determining whether or not the transfer memory is likely to occur based on the electrical resistance of the transfer roller 5. More specifically, in this embodiment, the threshold Y is set as a boundary value for determining whether or not the circumstance is the HH circumstance having a high temperature and a high humidity in which the transfer memory is likely to occur.

The threshold X and the threshold X2 are boundary values for determining whether or not the transfer memory occurs based on the accumulated time. The threshold X is similar to that used in the embodiment 1 and is a value previously set so that, even when images are formed with a relatively high printing ratio on small size sheets having a relatively high electrical resistance in the HH circumstance, an image failure that is not allowable caused by a transfer memory does not occur on the large size sheet immediately following the small size sheets. The threshold X2 is a value previously set so that, even when images are formed with a relatively high printing ratio on small size sheets having a relatively high electrical resistance in any of the normal-temperature and normal-humidity circumstance and the low-temperature and low-humidity circumstance, an image failure that is not allowable caused by a transfer memory does not occur on the large size sheet immediately following the small size sheets. In the following, the normal-temperature and normal-humidity circumstance will also be referred to as an "NN circumstance", and the low-temperature and low-humidity circumstance will also be referred to as an "LL circumstance".

As described above, the transfer memory is more likely to occur as the electrical resistance of the transfer roller 5 decreases, and therefore is likely to occur in the HH circumstance. Therefore, if the electrical resistance of the transfer roller 5 is less than the threshold Y (that is, the circumstance is the HH circumstance), the threshold X, which is assumed for the HH circumstance, is used as in the embodiment 1. On the other hand, if the electrical resistance of the transfer roller 5 is equal to or more than the threshold Y (that is, the circumstance is any of the NN circumstance or LL circumstance), the threshold X2, which is set to be greater than the threshold X, is used in order to ease the condition for selecting the second mode. In this embodiment, specifically, the threshold X is set to be the time required for 50 A5-size recording materials P to pass through the transfer nip portion N (top sensor 11), as in the embodiment 1. In this embodiment, specifically, the threshold X2 is set to be the time required for 74 A5-size recording materials P to pass through the transfer nip portion N (top sensor 11). As a result, under a condition where the transfer memory is not likely to occur, such as in the NN circumstance or LL circumstance, the number of small size sheets that can be fed until the sheet passing interval immediately preceding the first large size sheet is extended can be increased compared with the embodiment 1.

Although, in this embodiment, the sheet passing interval in the second mode is set to be the time required for one rotation of the photosensitive drum 1 as in the embodiment 1, the sheet passing interval is not limited to the time required for one rotation of the photosensitive drum 1. The sheet passing interval is not limited to a fixed value but can vary depending on the information on the accumulated time or the electrical resistance of the transfer roller 5, for example, and can be set to be the time required for two or three rotations of the photosensitive drum 1, for example. For example, the sheet passing interval may be greater in the second mode in the case where the electrical resistance of the transfer roller 5 assumes a second value smaller than a first value than in the second mode in the case where the electrical resistance of the transfer roller 5 assumes the first value.

Table 2 shows a result of the verification of the effect of the sheet passing interval change control that is similar to the verification in the embodiment 1 whose result is shown in Table 1 and is performed in the HH circumstance and a circumstance other than the HH circumstance. In this effect verification, immediately after A5-size sheets as small size sheets are successively fed, LTR-size sheets as large size sheets are fed. For comparison, the results for the embodiment 1 and the Comparative Example described above with regard to the embodiment 1 are also shown.

TABLE 2

| | Threshold of resistance of transfer roller | Number of successive A5-size sheets as small size sheets | | |
|---|---|---|---|---|
| | | 1 to 50 | 51 to 74 | Equal to or more than 75 |
| This embodiment | Equal to or more than Y (any of NN and LL is assumed) | Sheet interval: less than time required for one rotation of drum (first mode) | Sheet interval: less than time required for one rotation of drum (first mode) | Sheet interval: equal to or longer than time required for one rotation of drum (second mode) |

TABLE 2-continued

| | Threshold of resistance of transfer roller | Number of successive A5-size sheets as small size sheets | | |
|---|---|---|---|---|
| | | 1 to 50 | 51 to 74 | Equal to or more than 75 |
| | Less than Y (HH is assumed) | Sheet interval: less than time required for one rotation of drum (first mode) | Sheet interval: equal to or longer than time required for one rotation of drum (second mode) | Sheet interval: equal to or longer than time required for one rotation of drum (second mode) |
| Embodiment 1 | — | Sheet interval: less than time required for one rotation of drum (first mode) | Sheet interval: equal to or longer than time required for one rotation of drum (second mode) | Sheet interval: equal to or longer than time required for one rotation of drum (second mode) |
| Comparative Example | — | Sheet interval: equal to or longer than time required for one rotation of drum (no mode setting) | Sheet interval: equal to or longer than time required for one rotation of drum (no mode setting) | Sheet interval: equal to or longer than time required for one rotation of drum (no mode setting) |

As shown in Table 2, in this embodiment, if the estimated roller resistance value is less than the threshold Y, the threshold X is used, and the first mode is selected until the number of A5-size sheets successively fed before feeding of the large size sheets is started reaches 50. When the number of A5-size sheets successively fed before feeding of the large size sheets is started is 51 or more, the second mode is selected.

On the other hand, in this embodiment, if the estimated roller resistance value is equal to or more than the threshold Y, the threshold X2 is used, and the first mode is selected until the number of A5-size sheets successively fed before feeding of the large size sheets is started reaches 74. When the number of A5-size sheets successively fed before feeding of the large size sheets is started is 75 or more, the second mode is selected.

In this embodiment, in any of the HH circumstance and other circumstances than the HH circumstance, when images are successively formed on small size sheets with a relatively high printing ratio (about 75%), no transfer memory occurs on the large size sheets immediately following the small size sheets, regardless of the number of the small size sheets fed.

As described above, in this embodiment, the control unit 30 uses information of passage time and resistance on the electrical resistance of the transfer unit performing image transfer on the first recording material (small size sheet) P, as the transfer memory determination information. In addition, the control unit 30 performs control to set the sheet passing interval between the first recording material P and the second recording material (large size sheet) P to be the first interval (a time less than the time required for one rotation of the photosensitive member 1) if the time indicated by the passage time is the first time, and set the sheet passing interval to be the second interval (a time equal to or longer than the time required for one rotation of the photosensitive member 1) if the time indicated by the passage time is the second time greater than the first time. In addition, the control unit 30 performs the control to set the first time, for which the sheet passing interval can be set to be the first interval, to be greater when the electrical resistance indicated by the resistance is a second electrical resistance greater than a first electrical resistance than when the electrical resistance indicated by the resistance is the first electrical resistance. In particular, in this embodiment, the control unit 30 selects one of the first and second intervals based on comparison between the passage time and a threshold, as in the embodiment 1. The control unit 30 performs the control to use a greater threshold when the electrical resistance indicated by the resistance is the second electrical resistance than when the electrical resistance is the first electrical resistance. However, the control unit 30 may use only the resistance without using the passage time as the transfer memory determination information. In that case, the control unit 30 can perform control to set the sheet passing interval to be the first interval if the electrical resistance indicated by the resistance is a first electrical resistance, and set the sheet passing interval to be the second interval if the electrical resistance indicated by the resistance is a second electrical resistance smaller than the first electrical resistance.

As described above, according to this embodiment, the threshold X is optimized according to the electrical resistance of the transfer roller 5. As a result, for example, under a condition such as the NN circumstance and the LL circumstance where the electrical resistance of the transfer roller 5 is relatively high and the transfer memory is unlikely to occur, even when a large amount of small size sheets are successively fed, the sheet passing interval between the last small size sheet and the immediately following large size sheet can be reduced compared with the sheet passing interval in the embodiment 1. As a result, compared with the embodiment 1, the decrease of the productivity of image formation can be further reduced, and the reduction of the service life of the photosensitive drum 1 and other members can be further reduced.

Embodiment 3

Next, another embodiment of the present disclosure will be described. In this embodiment, information on the electrical resistance of the small size sheet and information on the passage time of the small size sheet are used as the transfer memory determination information.

As described above with regard to the embodiment 2 with reference to FIG. 10, the transfer memory caused by feeding of small size sheets depends on the ratio of the transfer current in the non-sheet-passing region A to the transfer current in the sheet-passing region B, and the relationship is expressed by the formula (2) described above.

$$I_A/I_B = Vdt/(R1+1/\omega C)/(Vdt/(R1+r+1/\omega C)) = 1+r/(R1+1/\omega C) \quad (2)$$

As can be seen from the above formula (2), the transfer current ratio ($I_A/I_B$) is affected by the resistance r of the small size sheet during feeding of the small size sheet and decreases as the resistance r of the small size sheet decreases. In other words, the higher the electrical resistance of the small size sheet is, the more likely the transfer memory is to occur.

In view of this, in this embodiment, the electrical resistance r of the small size sheet during feeding of the small size sheet is estimated, and the threshold X of the accumulated time described above with regard to the embodiment 1 is switched based on the estimated value of the electrical resistance (which is referred to as an "estimated sheet resistance value" herein). In this way, based on the information on the electrical resistance of the small size sheet and the information on the sheet feed time of the small size sheet used as the transfer memory determination information, the sheet passing interval between the last small size sheet and the first large size sheet is controlled. The estimated sheet resistance value is not limited to the electrical resistance itself but can be any index value correlated with the electrical resistance, such as a voltage value and a current value.

Figure 12:
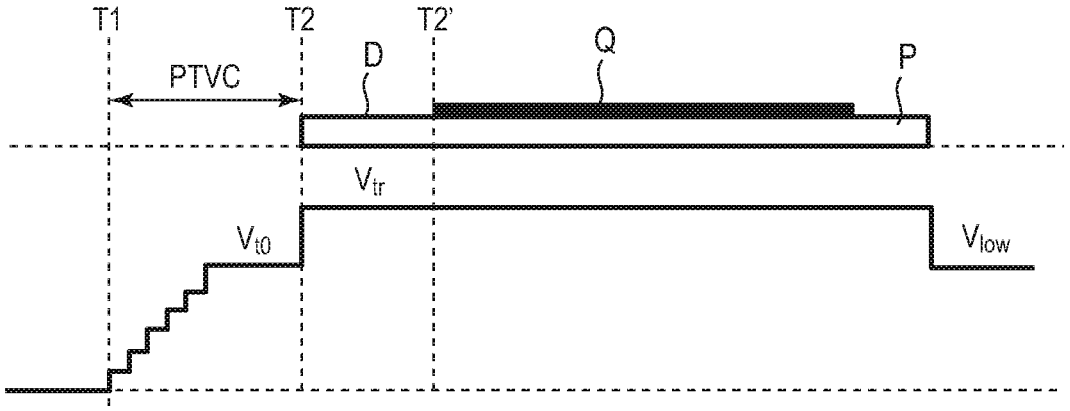
FIG. 12 is a chart for illustrating a method of detecting an electrical resistance of a small size sheet.

In this embodiment, the electrical resistance of the small size sheet is estimated from the value of the transfer current flowing to a margin region. Specifically, as shown in FIG. 12, a region between a time T2 at which the leading edge of the small size sheet P reaches the transfer nip portion N and a time T2' at which the leading edge of an image formation region Q in the conveyance direction of the small size sheet P reaches the transfer nip portion N is defined as a margin region D. In this embodiment, the control device 30 monitors a transfer current value I' flowing during application of the transfer bias Vtr when the margin region D is passing through the transfer nip portion N, and stores the transfer current value I' in the storage portion in the control device 30. However, the transfer current value I' varies under influence of both the resistance r of the small size sheet and the resistance R of the transfer roller 5. Therefore, in order to estimate the electrical resistance of the small size sheet with higher precision, not only the transfer current value I' but also the electrical resistance of the transfer roller 5 during measurement of the transfer current r can be considered.

Figure 13:
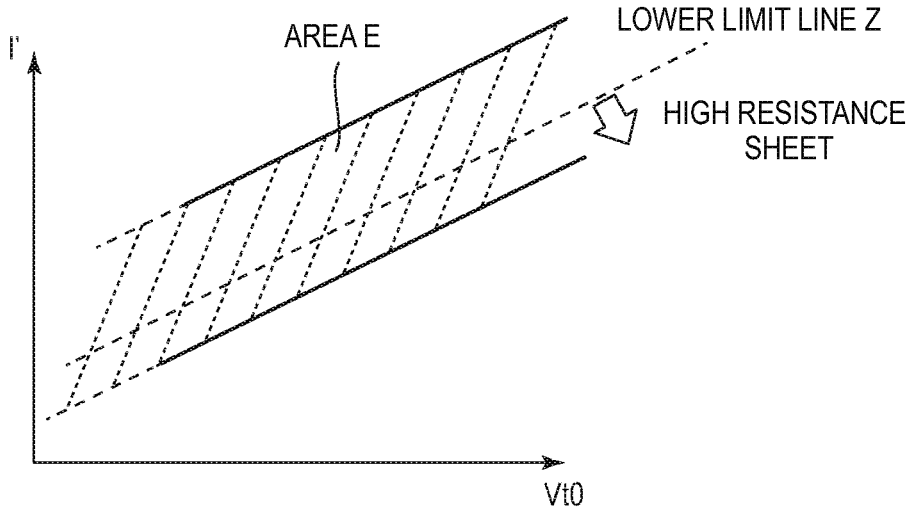
FIG. 13 is a graph for illustrating a method of discriminating a high resistance sheet.

FIG. 13 is a graph for illustrating a method of estimating the electrical resistance of the small size sheet in this embodiment. Vt0 in FIG. 13 represents a detected voltage value obtained by PTVC during the pre-rotation operation, which is a value used as an index value correlated with the electrical resistance of the transfer roller 5. I' in FIG. 13 represents the transfer current value detected in the margin region D. A region E in FIG. 13 represents a data group of Vt0 and I' obtained by feeding a plurality of kinds of recording materials P of different kinds, different basis weights and different moisture contents expected to be used in the image forming apparatus 100. In this embodiment, in the region E, a lower limit line Z of the transfer current value I' is set as a boundary line, and if it is detected that the transfer current value I' is lower than the lower limit line Z, it is determined that the relevant sheet is a small size sheet having a relatively high electrical resistance (referred to as a "high resistance sheet"). As the small size sheet having a transfer current value I' lower than the lower limit line Z, a small size sheet having a moisture content of 4% or less left standing in the LL circumstance is assumed. That is, in this embodiment, in the storage portion in the control device 30, information on the lower limit line Z, which is determined by the detected voltage value Vt0 and the transfer current value I', is previously set and recorded. The control device 30 compares the information on the lower limit line Z and the information on the detected voltage value Vt0 and the transfer current value I' obtained during feeding of the small size sheet, thereby determining whether or not the small size sheet is a high resistance sheet. In this embodiment, the information on the estimated sheet resistance value includes the detected voltage value Vt0 and the transfer current value I' required for estimation of the electrical resistance of the small size sheet.

Although the electrical resistance of the small size sheet is typically estimated in the margin region D on the side of the leading edge of the small size sheet, the estimation may be made in the margin region on the side of the trailing edge of the small size sheet. In addition, although the electrical resistance of the first small size sheet of a plurality of small size sheets is typically estimated, the electrical resistance of any of the second and subsequent small size sheets may be estimated. For example, the electrical resistance of the small size sheet immediately preceding the large size sheets may be estimated.

Figure 14:
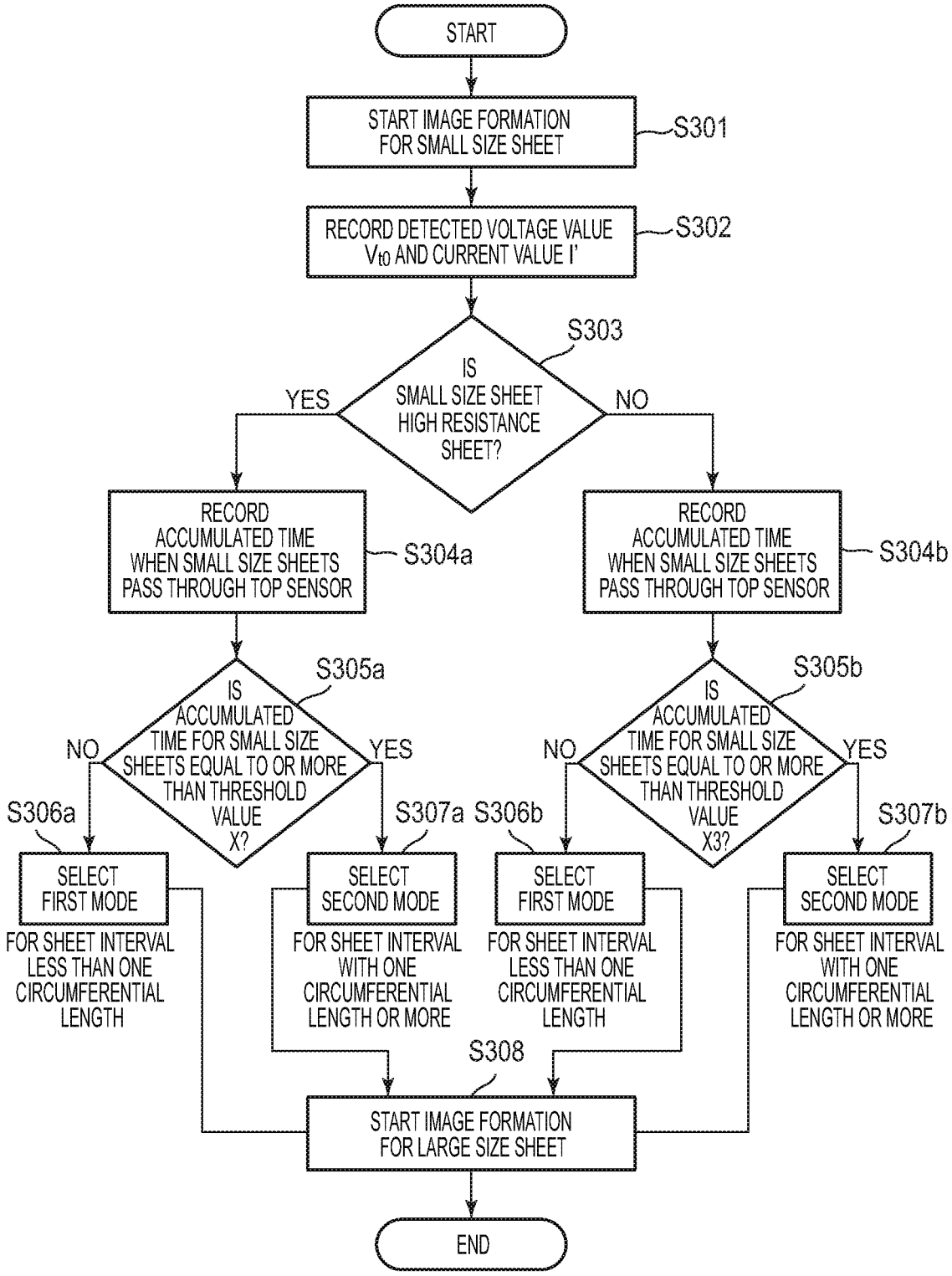
FIG. 14 is a flowchart showing a control according to an embodiment 3.

FIG. 14 is a flowchart showing an operation flow of a sheet passing interval change control according to this embodiment. According to this embodiment, based on the accumulated time, which is the accumulation of the sheet feed times of small size sheets, and the estimated sheet resistance value, the sheet passing interval between the last small size sheet and the immediately following large size sheet is controlled. This control is performed by the control device 30 according to a program or data (threshold and the like) stored in the storage portion in the control device 30. FIG. 14 shows an operation flow focused on changing the sheet passing interval, and many other processes typically required for performing the job are omitted in the drawing.

First, the control device 30 starts a job and starts image formation on small size sheets (S301). The control device 30 then records the information on the detected voltage value Vt0 and the transfer current value I' as the estimated sheet resistance value obtained for the margin region D described above in the storage portion in the control device 30 (S302). The control device 30 then determines whether or not the small size sheet is a high resistance sheet based on the information obtained in S302 (S303).

Next, a case will be described where, in S303, the control device 30 determines that the small size sheet is a high resistance sheet. The control device 30 measures the time required for the small size sheet to pass through the top sensor 11 by timer counting, and records the accumulated time thereof in the storage portion in the control device 30 to constantly update the content of the storage portion (S304*a*). The control device 30 then determines whether or not the latest accumulated time is equal to or more than a predetermined threshold X before feeding of the small size sheets is completed (that is, before supply of the large size sheets to the transfer nip portion N is started) (S305*a*). After that, the control device 30 performs processing of S306*a*, S307*a* and S308, which are the same as those of S104, S105 and S106 shown in FIG. 9 described above with regard to the embodiment 1, respectively. That is, if the accumulated time is less than the threshold X, the first mode (in which the sheet passing interval is less than the time required for one rotation of the photosensitive drum 1) is selected, and if the accumulated time is equal to or more than the threshold X, the second mode (in which the sheet passing interval is equal to or longer than the time required for one rotation of the photosensitive drum 1) is selected.

Next, a case will be described where, in S303, the control device 30 determines that the small size sheet is not a high resistance sheet. In this case, again, the control device 30 performs processing of S304*b*, S305*b*, S306*b*, S307*b* and S308, which are similar to those of S304*a*, S305*a*, S306*a*, S307*a* and S308 described above, respectively. However, in S305*b*, the control device 30 determines whether or not the accumulated time is equal to or more than a predetermined threshold X3 (>X). That is, if the accumulated time is less than the threshold X3, the first mode (in which the sheet passing interval is less than the time required for one rotation of the photosensitive drum 1) is selected, and if the accumulated time is equal to or more than the threshold X3, the second mode (in which the sheet passing interval is equal to or longer than the time required for one rotation of the photosensitive drum 1) is selected.

The thresholds X and X3 are boundary values for determining whether or not the transfer memory occurs based on the accumulated time. The threshold X is similar to that used in the embodiment 1 and is a value previously set so that, even when images are formed with a relatively high printing ratio on small size sheets that are high resistance sheets in the HH circumstance, an image failure that is not allowable caused by the transfer memory does not occur on the large size sheet immediately following the small size sheets. The threshold X3 is a value previously set so that, even when images are formed with a relatively high printing ratio on small size sheets that are not high resistance sheets in the HH circumstance, an image failure that is not allowable caused by the transfer memory does not occur on the large size sheet immediately following the small size sheets.

As described above, the transfer memory is more likely to occur as the electrical resistance of the small size sheet increases. Therefore, if the small size sheet is a high resistance sheet, the threshold X is used as in the embodiment 1. On the other hand, if the small size sheet is not a high resistance sheet, the threshold X3, which is set to be greater than the threshold X, is used in order to ease the condition for selecting the second mode. In this embodiment, specifically, the threshold X is set to be the time required for 50 A5-size recording materials P to pass through the transfer nip portion N (top sensor 11), as in the embodiment 1. In this embodiment, specifically, the threshold X3 is set to be the time required for 74 A5-size recording materials P to pass through the transfer nip portion N (top sensor 11). As a result, under a condition where the electrical resistance of the small size sheet is low, and the transfer memory is not likely to occur, the number of small size sheets that can be fed until the sheet passing interval immediately preceding the first large size sheet is extended can be increased compared with the embodiment 1.

Although, in this embodiment, the sheet passing interval in the second mode is set to be the time required for one rotation of the photosensitive drum 1 as in the embodiment 1, the sheet passing interval is not limited to the time required for one rotation of the photosensitive drum 1. The sheet passing interval is not limited to a fixed value but can vary depending on the information on the accumulated time or the electrical resistance of the small size sheet, for example, and can be set to be the time required for two or three rotations of the photosensitive drum 1, for example. For example, the sheet passing interval may be greater in the second mode in the case where the electrical resistance of the small size sheet assumes a second value greater than a first value than in the second mode in the case where the electrical resistance of the small size sheet assumes the first value.

Table 3 shows a result of the verification of the effect of the sheet passing interval change control that is similar to the verification in the embodiment 1 whose result is shown in Table 1 and is performed for small size sheets that are high resistance sheets and small size sheets that are not high resistance sheets. In this effect verification, immediately after A5-size sheets as small size sheets are successively fed, LTR-size sheets as large size sheets are fed. For comparison, the results for the embodiment 1 and the Comparative Example described above with regard to the embodiment 1 are also shown.

TABLE 3

| | Resistance of A5-size sheet as small size sheet | Number of successive A5-size sheets as small size sheets | | |
|---|---|---|---|---|
| | | 1 to 50 | 51 to 74 | Equal to or more than 75 |
| This embodiment | Not high resistance sheets | Sheet interval: less than time required for one rotation of drum (first mode) | Sheet interval: less than time required for one rotation of drum (first mode) | Sheet interval: equal to or longer than time required for one rotation of drum (second mode) |
| | High resistance sheets | Sheet interval: less than time required for one rotation of drum (first mode) | Sheet interval: equal to or longer than time required for one rotation of drum (second mode) | Sheet interval: equal to or longer than time required for one rotation of drum (second mode) |
| Embodiment 1 | — | Sheet interval: less than time required for one rotation of drum (first mode) | Sheet interval: equal to or longer than time required for one rotation of drum (second mode) | Sheet interval: equal to or longer than time required for one rotation of drum (second mode) |
| Comparative Example | — | Sheet interval: equal to or longer than time required for one rotation of drum (no mode setting) | Sheet interval: equal to or longer than time required for one rotation of drum (no mode setting) | Sheet interval: equal to or longer than time required for one rotation of drum (no mode setting) |

As shown in Table 3, in this embodiment, if the A5-size sheets are not high resistance sheets, the threshold X is used, and the first mode is selected until the number of A5-size sheets successively fed before feeding of the large size sheets is started reaches 50. When the number of A5-size sheets successively fed before feeding of the large size sheets is started is 51 or more, the second mode is selected.

On the other hand, in this embodiment, if the A5-size sheets are high resistance sheets, the threshold X3 is used, and the first mode is selected until the number of A5-size sheets successively fed before feeding of the large size sheets is started reaches 74. When the number of A5-size sheets successively fed before feeding of the large size sheets is started is 75 or more, the second mode is selected.

In this embodiment, in any of the small size sheet that is a high resistance sheet and the small size sheet that is not a high resistance sheet is used, when images are successively formed on small size sheets with a relatively high printing ratio (about 75%), no transfer memory occurs on the large size sheets immediately following the small size sheets, regardless of the number of the small size sheets fed.

As described above, in this embodiment, the control unit 30 uses passage time and recording material resistance on the electrical resistance of the first recording material (small size sheet) P as the transfer memory determination information. In addition, the control unit 30 performs control to set the sheet passing interval between the first recording material P and the second recording material (large size sheet) P to be the first interval if the time indicated by the passage time is the first time, and set the sheet passing interval to be the second interval if the time indicated by the passage time is the second time greater than the first time. In addition, the control unit 30 performs the control to set the first time, for which the sheet passing interval can be set to be the first interval, to be greater when the electrical resistance indicated by the recording material resistance is a second electrical resistance less than a first electrical resistance than when the electrical resistance indicated by the recording material resistance is the first electrical resistance. In particular, in this embodiment, the control unit 30 selects one of the first and second intervals based on comparison between the passage time and a threshold, as in the embodiment 1. The control unit 30 performs the control by using a greater threshold when the electrical resistance indicated by the recording material resistance is the second electrical resistance than when the electrical resistance is the first electrical resistance. However, the control unit 30 may use only the recording material resistance without using the passage time as the transfer memory determination information. In that case, the control unit 30 can perform control to set the sheet passing interval to be the first interval if the electrical resistance indicated by the recording material resistance is a first electrical resistance, and set the sheet passing interval to be the second interval if the electrical resistance indicated by the recording material resistance is a second electrical resistance greater than the first electrical resistance.

As described above, according to this embodiment, the threshold X is optimized according to the electrical resistance of the small size sheet. As a result, for example, under a condition where the electrical resistance of the small size sheet is relatively low and the transfer memory is unlikely to occur, even when a large amount of small size sheets are successively fed, the sheet passing interval between the last small size sheet and the immediately following large size sheet can be reduced compared with the sheet passing interval in the embodiment 1. As a result, compared with the embodiment 1, the decrease of the productivity of image formation can be further reduced, and the reduction of the service life of the photosensitive drum 1 and other members can be further reduced.

Embodiment 4

Next, yet another embodiment of the present disclosure will be described. In this embodiment, as the transfer memory determination information, information on the printing ratio of the image formed on the small size sheet and information on the passage time of the small size sheet are used.

Figure 15:
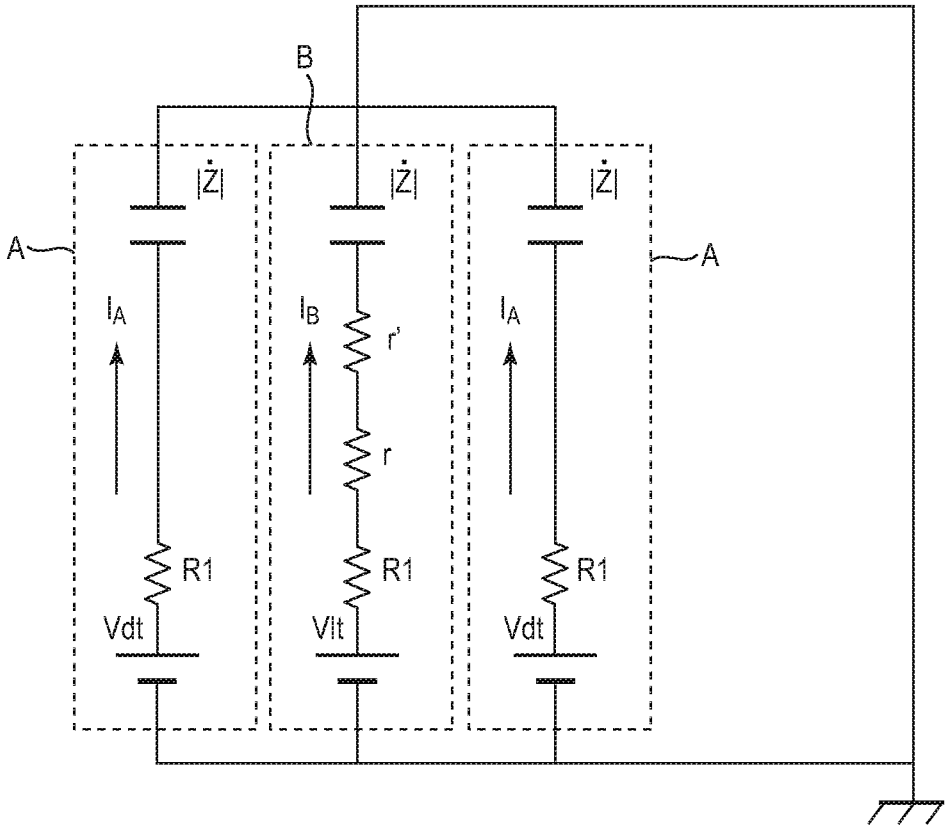
FIG. 15 is a schematic diagram showing an electrical resistance relationship between the sheet-present region and the non-sheet-passing region in the transfer nip portion.

FIG. 15 is a schematic diagram showing an electrical resistance relationship between the sheet-passing region and the non-sheet-passing region in the transfer nip portion N during feeding of a small size sheet in the presence of toner. As shown in FIG. 15, a cross section of the transfer nip portion N (a cross section taken along the longitudinal direction of the transfer nip portion N) is schematically divided into non-sheet-passing regions A and a sheet-passing region B. A resistance R1 represents a divisional resistance of the transfer roller 5 in the non-sheet-passing regions A and the sheet-passing region B. A resistance r represents an electrical resistance of the small size sheet held by the transfer nip portion N. A resistance r' represents an impedance of toner printed. A voltage Vdt represents a potential contrast that is the potential difference Vd−Vtr between the transfer bias Vtr applied to the transfer roller 5 during sheet feeding and the potential Vd of a non-image formation region (non-print region) of the photosensitive drum 1. A voltage Vlt represents a potential contrast that is the potential difference Vl−Vtr between the transfer bias Vtr applied to the transfer roller 5 during sheet feeding and an average potential Vl of an image formation region (print region) of the photosensitive drum 1. An impedance Zi represents an impedance of the photosensitive drum 1 opposed to the transfer roller 5 and is expressed as 1/ωC using an angular frequency ω and a capacitance C of the photosensitive drum 1. A current $I_A$ represents a transfer current flowing to the non-sheet-passing regions A and is expressed as Vdt/(R1+1/ωC) according to a relationship between the voltage Vdt, the resistance R1 and the impedance Zi. A current $I_B$ is a transfer current flowing to the sheet-passing region B and is expressed as Vlt/(R1+r+r'+1/ωC) according to a relationship between the voltage Vlt and a combined resistance of the resistances R1, r and r' and the impedance Zi.

The transfer memory caused by feeding of a small size sheet depends on the ratio of the transfer current in the non-sheet-passing region A to the transfer current in the sheet-passing region B and is expressed by the following formula (3).

$$I_A/I_B = Vdt/(R1+1/\omega C)/(Vlt/(R1+r+r'+1/\omega C)) = Vdt/Vlt \times (1+(r+r')/(R1+1/\omega C) \quad (3)$$

As can be seen from the above formula (3), as in the case where the printing ratio during feeding of the small size sheet is low, the transfer current ratio ($I_A/I_B$) decreases as the impedance r' of the toner decreases. In addition, as the printing ratio decreases, the potential contrast Vlt in the sheet-passing region increases, and therefore, the transfer current ratio further decreases according to the formula (3). In other words, the higher the printing ratio during feeding of the small size sheet is, the more likely the transfer memory is to occur.

In view of this, in this embodiment, the printing ratio during feeding of a small size sheet (printing ratio of an image formed on a small size sheet) is measured, and the accumulated time described above with regard to the embodiment 1 is corrected based on the printing ratio. In this way, based on the information on the printing ratio of the image formed on the small size sheet and the information on the passage time of the small size sheet as the transfer memory determination information, the sheet passing interval between the last small size sheet and the first large size sheet is controlled. Although the information on the printing ratio determined in the manner described below is used in this embodiment, the printing ratio is not limited to the printing ratio determined in the manner described below. In addition, although the printing ratio itself is used as the information concerning the printing ratio in this embodiment, any index value correlated with the printing ratio of the image formed on the small size sheet (that is, any index value correlated with the amount of toner of the image formed on the small size sheet) can also be used.

Figure 16:
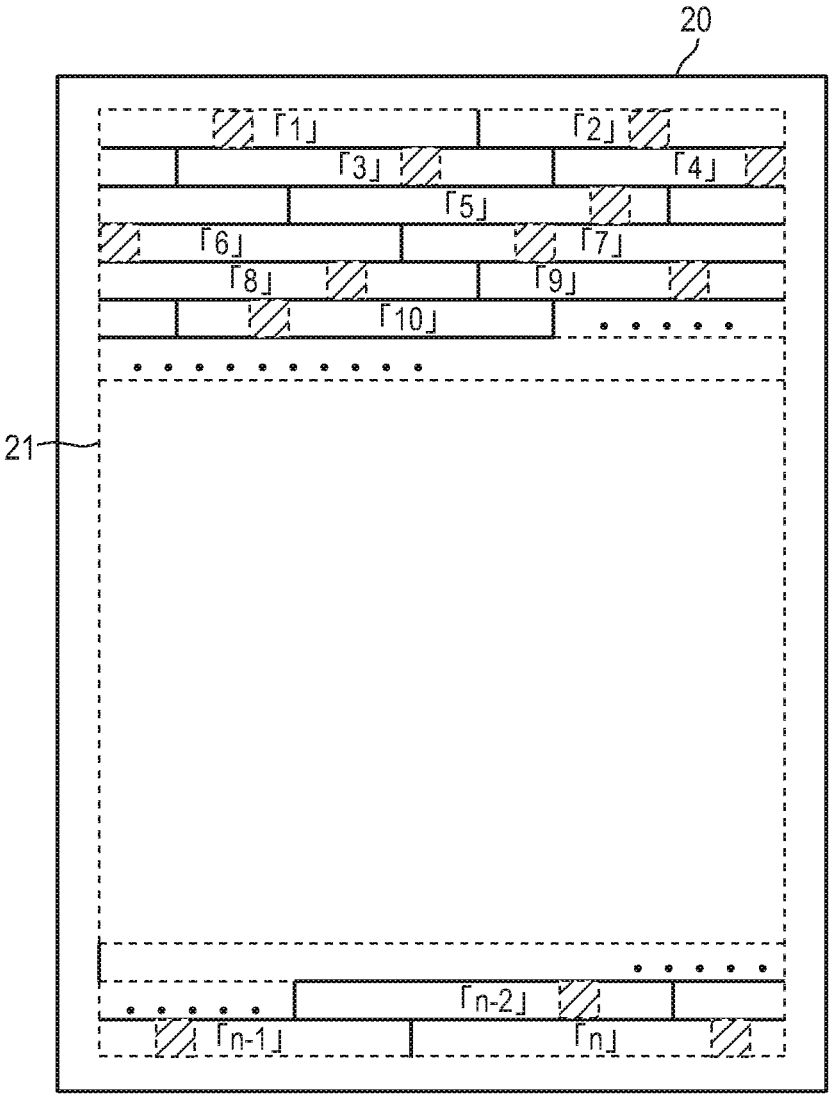
FIG. 16 is a schematic diagram for illustrating a method of calculating a printing ratioprinting ratio.

With reference to FIG. 16, a method of calculating the printing ratio according to this embodiment will be described. As a method of calculating the printing ratio, any available method can be used. However, an exemplary printing ratio calculation method based on a laser lighting ratio will be described. The laser lighting ratio can be calculated by sampling video signals in a predetermined image formation region (print region) at intervals of a predetermined time and calculating the ratio of the number of video signals in the on state to the total number of samples. In FIG. 16, reference numeral 50 denotes a transfer material P on which an image is printed. Reference numeral 51 denotes an image formation region (print region), which is a region in (on) the recording material P in which an image can be printed. The image formation region (print region) 51 is divided into n sub-regions (n: natural number), and the n sub-regions are numbered "1" to "n". The areas with hatches in FIG. 16 represent points randomly chosen in the n sub-regions, and only one area with hatches is chosen in each sub-region. The on/off state of the video signal is determined at the points, and the points at which the video signal is in the on state are counted. The laser lighting ratio, which is associated with the printing ratio, can be calculated by dividing the count by the number (n, in this example) of sub-regions in the image formation region (print region). Strictly speaking, the value calculated in this way does not always agree with the actual laser lighting ratio. However, as the number n of samples increases sufficiently, the calculated value becomes approximately equal to the actual laser lighting ratio, although the determination of the on/off state takes time. In this way, the control device 30 can calculate the laser lighting ratio per page and estimate the printing ratio in one page.

Figure 17:
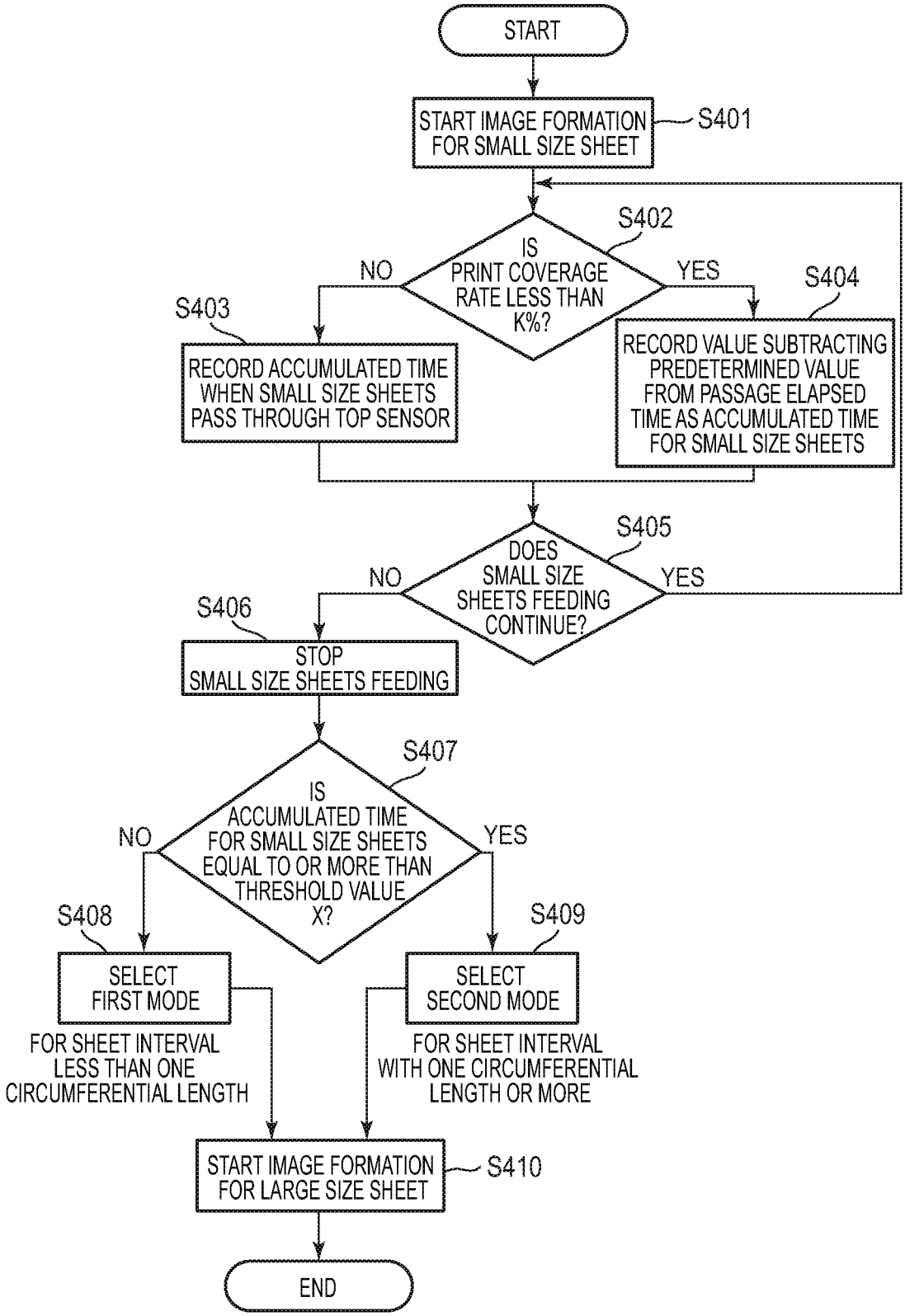
FIG. 17 is a flowchart showing a control according to an embodiment 4.

FIG. 17 is a flowchart showing an operation flow of a sheet passing interval change control according to this embodiment. According to this embodiment, based on the accumulated time, which is the accumulation value of the sheet feed times of small size sheets, and the printing ratio of the images formed on the small size sheets, the sheet passing interval between the last small size sheet and the immediately following large size sheet is controlled. This control is performed by the control device 30 according to a program or data (threshold and the like) stored in the storage portion in the control device 30. FIG. 17 shows an operation flow focused on changing the sheet passing interval, and many other processes typically required for performing the job are omitted in the drawing.

First, the control device 30 starts a job and starts image formation on small size sheets (S401). The control device 30 then determines whether or not the printing ratio of the image formed on each of the small size sheets being fed is less than a predetermined threshold K % (S402). If it is determined in S402 that the printing ratio is not less than K %, the control device 30 measures the time required for the small size sheet to pass through the top sensor 11 by timer counting, determines the accumulated time by accumulating the measured passage times as they are, and records the accumulated time in the storage portion in the control device 30 to update the content of the storage portion (S403). If it is determined in S402 that the printing ratio is less than K %, the control device 30 proceeds to the processing described below. That is, the control device 30 measures the time required for the small size sheet to pass through the top sensor 11 by timer counting, determines the accumulated time by accumulating values obtained by subtracting a predetermined value from the measured data of the passage time, and records the accumulated time in the storage portion in the control device 30 to update the content of the storage portion (S404).

The control device 30 then determines whether or not feeding of the small size sheets continues (S405). If it is determined in S405 that feeding of the small size sheets continues, the control device 30 returns to the processing of S402. On the other hand, if it is determined in S405 that feeding of the small size sheets does not continue (the small size sheet now being fed is the last small size sheet), the control device 30 stops feeding of the small size sheets (S406). In addition, before feeding of the small size sheets is completed (that is, before supply of the large size sheets to the transfer nip portion N is started), the control device 30 determines whether or not the latest accumulated time is equal to or more than a predetermined threshold X (S407). After that, the control device 30 performs processing of S408, S409 and S410, which are the same as those of S104, S105 and S106 shown in FIG. 9 described above with regard to the embodiment 1, respectively. That is, if the accumulated time is less than the threshold X, the first mode (in which the sheet passing interval is less than the time required for one rotation of the photosensitive drum 1) is selected, and if the accumulated time is equal to or more than the threshold X, the second mode (in which the sheet passing interval is equal to or longer than the time required for one rotation of the photosensitive drum 1) is selected.

The threshold K % is a boundary value for determining whether the effect of the printing ratio of the image formed on the small size sheet on the transfer memory is great or not. As the threshold K %, a value can be previously set that can make the transfer memory unlikely to occur to an extent that the increase of the accumulated time can be cancelled to some extent when the printing ratio of the images formed on the small size sheets is less than the threshold K %. In this embodiment, the threshold K % is set so that when images all having a printing ratio less than K % are successively formed on A5-size sheets having a moisture content of about 4% and a relatively high electrical resistance in an HH circumstance in which the temperature is 30° C. and the humidity is 85%, no transfer memory occurs on the immediately following large size sheet if the number of the A5-size sheets is up to 50. Specifically, in this embodiment, the threshold K % is set at 75%.

Although, in this embodiment, the sheet passing interval in the second mode is set to be the time required for one rotation of the photosensitive drum 1 as in the embodiment 1, the sheet passing interval is not limited to the time required for one rotation of the photosensitive drum 1. The sheet passing interval is not limited to a fixed value but can vary depending on the information on the accumulated time or the printing ratio of the images formed on the small size sheets, for example, and can be set to be the time required for two or three rotations of the photosensitive drum 1, for example. For example, the sheet passing interval may be greater in the second mode in the case where the average printing ratio of the images formed on the small size sheets assumes a second value greater than a first value than in the second mode in the case where the average printing ratio assumes the first value.

Table 4 shows a result of the verification of the effect of the sheet passing interval change control that is similar to the verification in the embodiment 1 whose result is shown in Table 1 and is performed for a relatively high printing ratio and a relatively low printing ratio of the images formed on the small size sheets. In this effect verification, immediately after A5-size sheets as small size sheets are successively fed, LTR-size sheets as large size sheets are fed. For comparison, the results for the embodiment 1 and the Comparative Example described above with regard to the embodiment 1 are also shown.

TABLE 4

| | Printing ratio of A5-size sheets as small size sheets | Number of successive A5-size sheets as small size sheets | | |
|---|---|---|---|---|
| | | 1 to 50 | 51 to 74 | Equal to or more than 75 |
| This embodiment | All less than K % | Sheet interval: less than time required for one rotation of drum (first mode) | Sheet interval: less than time required for one rotation of drum (first mode) | Sheet interval: equal to or longer than time required for one rotation of drum (second mode) |
| | Equal to or more than K % on average | Sheet interval: less than time required for one rotation of drum (first mode) | Sheet interval: equal to or longer than time required for one rotation of drum (second mode) | Sheet interval: equal to or longer than time required for one rotation of drum (second mode) |
| Embodiment 1 | — | Sheet interval: less than time required for one rotation of drum (first mode) | Sheet interval: equal to or longer than time required for one rotation of drum (second mode) | Sheet interval: equal to or longer than time required for one rotation of drum (second mode) |
| Comparative Example | — | Sheet interval: equal to or longer than time required for one rotation of drum (no mode setting) | Sheet interval: equal to or longer than time required for one rotation of drum (no mode setting) | Sheet interval: equal to or longer than time required for one rotation of drum (no mode setting) |

As shown in Table 4, in this embodiment, if the average printing ratio of the images formed on the A5-size sheets is equal to or more than K %, the first mode is selected until the number of A5-size sheets successively fed before feeding of the large size sheets is started reaches 50. When the number of A5-size sheets successively fed before feeding of the large size sheets is started is 51 or more, the second mode is selected.

On the other hand, if the printing ratios of the images formed on the A5-size sheets are all less than K %, even when 74 sheets are successively fed, and the accumulated time for the 74 sheets is counted, the accumulated time equivalent to 51 sheets is recorded in the control device 30 because of the subtraction processing described above. As a result, the first mode continues being selected until the number of A5-size sheets successively fed before feeding of the large size sheets is started reaches 74. When the number of A5-size sheets successively fed before feeding of the large size sheets is started is 75 or more, the second mode is selected.

In this embodiment, in any of the case where the printing ratio of the images formed on the small size sheets is relatively high and the case where the printing ratio is relatively low, no transfer memory occurs on the large size sheets immediately following the small size sheets, regardless of the number of the small size sheets fed.

As described above, in this embodiment, the control unit 30 uses the passage time and the printing ratio concerning the printing ratio of the image formed on the first recording material (small size sheet) P as the transfer memory determination information. In addition, the control unit 30 performs control to set the sheet passing interval between the first recording material P and the second recording material (large size sheet) P to be the first interval if the time indicated by the passage time is the first time, and set the sheet passing interval to be the second interval if the time indicated by the passage time is the second time greater than the first time. In addition, the control unit 30 performs the control to set the first time, for which the sheet passing interval can be set to be the first interval, to be greater when the printing ratio is a second printing ratio smaller than a first printing ratio than when the printing ratio is the first printing ratio. In particular, in this embodiment, the control unit 30 selects one of the first and second intervals based on comparison between the passage time and a threshold, as in the embodiment 1. When the printing ratio is the second printing ratio, the control unit 30 performs the control by correcting the passage time so that the time indicated by the passage time is reduced, and comparing the corrected passage time with the threshold described above. However, the control unit 30 may use only the printing rate without using the passage time as the transfer memory determination information. In that case, the control unit 30 can perform control to set the sheet passing interval to be the first interval if the printing ratio is the first printing ratio, and set the sheet passing interval to be the second interval if the printing ratio is the second printing ratio greater than the first printing ratio.

As described above, according to this embodiment, when the printing ratio of the images formed on the small size sheets is relatively low, the accumulated time, which is the accumulation value of the data of the passage time of the small size sheets, is reduced by subtraction. As a result, for example, under a condition where the printing ratio of the images formed on the small size sheets is low, and the transfer memory is unlikely to occur, even when a large amount of small size sheets are successively fed, the sheet passing interval between the last small size sheet and the immediately following large size sheet can be reduced compared with the embodiment 1. As a result, compared with the embodiment 1, the decrease of the productivity of image formation can be further reduced, and the reduction of the service life of the photosensitive drum 1 and other members can be further reduced.

[Others]

Although the present disclosure has been described with regard to specific embodiments, the present disclosure is not limited to the embodiments described above.

For example, the detection units for the electrical resistance of the transfer roller, the electrical resistance of the recording material, the printing ratio and the like are not limited to those described above with regard to the embodiments, and any available unit can be used.

The information on the passage time of the small size sheet, the information on the electrical resistance of the transfer roller, the information on the electrical resistance of the recording material and the information on the printing ratio illustrated as the transfer memory determination information may not always be singly processed but can be used in any combination.

The photosensitive member is not limited to the drum-shaped body described above but may be any rotatable body, such as an endless belt (film) and a film stretched over a rotatable frame.

Although the recording material has been described as being conveyed in the center-referenced conveyance scheme in the embodiments described above, the present disclosure is not limited to this scheme. The present disclosure can be equally applied to an image forming apparatus in which the recording material is conveyed with one of the edges thereof in the direction substantially perpendicular to the conveyance direction aligned with one of the edges of the photosensitive member in the direction substantially perpendicular to the movement direction of the surface thereof, and the same advantages as those of the embodiments described above can be achieved in that case.

As can be seen from the description of the embodiment 2, the ease of occurrence of the transfer memory depends on the circumstance in which images are formed on small size sheets. This is because the electrical resistance of the transfer roller varies with the circumstance (the electrical resistance is relatively low in the HH circumstance and is relatively high in any of the NN circumstance and LL circumstance) as described above with regard to the embodiment 2. That is, the detection unit for the information concerning the electrical resistance of the transfer roller in the embodiment 2 also has a function as a detection unit for information concerning the circumstance. Therefore, for example, instead of the information on the electrical resistance of the transfer roller used in the embodiment 2, information concerning the circumstance detected by a circumstance detection unit such as a temperature/humidity sensor may be used as the transfer memory determination information. In this regard and as far as the information is adequately correlated with the ease of occurrence of the transfer memory, the information concerning the circumstance may be information on at least one of (i) the temperature of at least one of the inside or outside of the image forming apparatus or (ii) the humidity of at least one of the inside or outside of the image forming apparatus. In such a case, for example, as shown in FIG. 1, a circumstance sensor 60 including a temperature/humidity sensor capable of detecting the temperature and humidity of the atmosphere around the transfer portion can be provided in the image forming apparatus 100, and the information (signal) concerning the detection result can be input to the control device 30.

For example, the control unit can use the passage time and the circumstance information as the transfer memory determination information. In addition, as in the embodiment 2, the control unit perform control to set the sheet passing interval between the last small size sheet and the immediately following large size sheet to be the first interval (a time less than the time required for one rotation of the photosensitive member) if the time indicated by the passage time is the first time, and set the sheet passing interval to be the second interval (a time equal to or longer than the time required for one rotation of the photosensitive member) if the time indicated by the passage time is the second time greater than the first time. In this case, the control unit may perform the control to set the first time, for which the sheet passing interval can be set to be the first interval, to be greater (i) when at least one of the following conditions is satisfied: that the temperature indicated by the circumstance is a second temperature lower than a first temperature or that the humidity indicated by the circumstance is a second humidity lower than a first humidity than (ii) when at least one of the following conditions is satisfied: that the temperature indicated by the circumstance is the first temperature or that the humidity indicated by the circumstance is the first humidity. As in the case where the resistance is used, the control unit can select one of the first and second intervals based on comparison between the passage time and a threshold. The control unit may perform the control by using a relatively greater threshold (i) when the circumstance indicates at least one of the lower temperature or the lower humidity than (ii) when the circumstance indicates at least one of the higher temperature or the higher humidity. Furthermore, as in the case where the resistance is used, the control unit may select one of the first interval or the second interval depending on whether the circumstance (i) indicates at least one of the lower temperature or the lower humidity or (ii) indicates at least one of the higher temperature or the higher humidity (the second interval is selected when one of the higher temperature and the higher humidity is indicated).

As described above, the predetermined information concerning the image transfer onto the small size sheet (transfer memory determination information) can be at least one the following: information item selected from the information items including the passage time, the resistance of the transfer unit, the circumstance, the resistance of the recording material, or the printing ratio. The passage time can be as information on the number of small size sheets having passed through the transfer portion.

In the embodiments 2 and 3, as in the embodiment 4, the threshold may be fixed, and the accumulation value of the passage time may be reduced by subtraction, so that the passage time of the small size sheets at which feeding of the immediately following large size sheet can be started (that is, the number of small size sheets that can be fed before feeding of the large size sheets is started) can be changed without extending the sheet passing interval. Conversely, in the embodiment 4, as in the embodiments 2 and 3, the accumulation value of the passage time may not be reduced by subtraction, and a plurality of thresholds may be provided, so that the passage time of the small size sheets at which feeding of the immediately following large size sheet can be started (that is, the number of small size sheets that can be fed before feeding of the large size sheets is started) can be changed without extending the sheet passing interval.

In the embodiments described above, reduction of an image failure occurring in an image forming apparatus including a photosensitive member as an image bearing body when an electrostatic trace is caused on the photosensitive member by a transfer current has been described. However, the present disclosure is not limited to this application. The present disclosure can be applied to an image forming apparatus including an intermediate transfer body such as an intermediate transfer belt as an image bearing body, and the same advantages can be achieved in such a case. The image forming apparatus of the intermediate transfer type forms an image on a recording material by performing primary transfer of a toner image formed on a photosensitive member onto an intermediate transfer body and then performing secondary transfer of the toner image from the intermediate transfer body onto the recording material in a secondary transfer portion in which the intermediate transfer body and the recording material comes into contact with each other. With the image forming apparatus of the intermediate transfer type, when a large size sheet is fed after feeding of a small size sheet, an electrostatic trace may be caused on the intermediate transfer body by the current flowing in the secondary transfer portion. If the electrostatic trace occurs, during the primary transfer of the toner image from the photosensitive member onto the intermediate transfer body, the primary transfer may be degraded at the portion of the intermediate transfer body at which the electrostatic trance has occurred. Therefore, the arrangements according to the embodiments described above can be applied to the image forming apparatus of the intermediate transfer type to achieve the same advantages. In short, the present disclosure can be applied to any image forming apparatus of the intermediate transfer type (such as a color image forming apparatus) that has an intermediate transfer body (such as an intermediate transfer belt formed by an endless belt) as a rotatable image bearing body and transfers a toner image from the intermediate transfer body onto a recording material. Any control unit can be used that can change the sheet passing interval between the last small size sheet and the large size sheet immediately following the small size sheet to one of a first interval less than a time required for one rotation of the image bearing body and a second interval equal to or longer than the time required for one rotation of the image bearing body based on predetermined information concerning the transfer of a toner image from the image bearing body onto the small size sheets when images are successively formed on small size sheets and large size sheets.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-061984, filed Mar. 27, 2019, which is hereby incorporated by reference herein in its entirety.

What is claimed is:

1. An image forming apparatus comprising:

a photosensitive member that is rotatable and configured to bear a toner image;

a transfer member configured to perform a transfer of the toner image borne on the photosensitive member onto a recording material;

a power supply configured to apply a voltage for the performed transfer to the transfer member;

a conveyance unit configured to convey the recording material to a transfer portion where the transfer member opposes the photosensitive member; and a control unit configured to control the conveyance unit, wherein, in a case where an image is successively formed on a first recording material and a second recording material conveyed to the transfer portion following the first recording material, the control unit changes a time interval to a first interval or a second interval based on predetermined information concerning the transfer onto the first recording material, wherein the first recording material has a first width in a width direction perpendicular to a conveyance direction of the recording material and the second recording material has a second width greater than the first width in the width direction, wherein the time interval is an interval between a time when a trailing edge of the first recording material in the conveyance direction completely passes through the transfer portion and a time when a leading edge in the conveyance direction of the second recording material conveyed to the transfer portion immediately following the first recording material reaches the transfer portion, and wherein the first interval is a time period corresponding to a rotation equal to less than one rotation of the photosensitive member and the second interval is a time period corresponding to a rotation equal to one rotation or more than one rotation of the photosensitive member.

2. The image forming apparatus according to claim 1, wherein the predetermined information is at least one selected from the following information items: (i) a passage time concerning a time when the first recording material passes through the transfer portion, (ii) a transfer member resistance concerning an electrical resistance value of the transfer member when performing the transfer onto the first recording material, (iii) circumstance concerning at least one of temperature and humidity, (iv) recording material resistance concerning an electrical resistance value of the first recording material, and (v) a printing ratio of an image formed on the first recording material.

3. The image forming apparatus according to claim 2, wherein the information item of the passage time including information concerning a number of sheets of the first recording material passing through the transfer portion.

4. The image forming apparatus according to claim 2, wherein the control unit is configured to use the information item of the passage time as the predetermined information, and wherein the control unit performs control to set the first interval as the time interval in a case where a time indicated by the passage time is time equal to a first time, and performs a control to set the time interval to be the second interval in a case where the indicated time is a second time greater than the first time.

5. The image forming apparatus according to claim 4, wherein the control unit performs control to set the first interval as the time interval in a case where the indicated time is less than a predetermined threshold, and performs control to set the second interval as the time interval in a case where the indicated time is equal to or more than the predetermined threshold.

6. The image forming apparatus according to claim 2, wherein the control unit is configured to use the information item of the passage time and the information item of the transfer member resistance as the predetermined information, and wherein the control unit performs control to set the first interval as the time interval in a case where a time indicated by the passage time is less than a predetermined threshold and performs control to set the second interval as the time interval in a case where the indicated time is equal to or more than the predetermined threshold, and wherein a first value is used as the predetermined threshold in a case where the electrical resistance indicated by the transfer member resistance is a first electrical resistance value, and a second value greater than the first value is used as the predetermined threshold in a case where the electrical resistance indicated by the transfer member resistance is a second electrical resistance value greater than the first electrical resistance value.

7. The image forming apparatus according to claim 2, wherein the control unit is configured to use the information item of the recording material resistance as the predetermined information, and wherein the control unit performs control to set the first interval as the time interval in a case where an electrical resistance value indicated by the recording material resistance is a first electrical resistance value, and performs control to set the second interval as the time interval in a case where the electrical resistance value indicated by the recording material resistance is a second electrical resistance value smaller than the first electrical resistance value.

8. The image forming apparatus according to claim 2, wherein the control unit is configured to use the information item of the circumstance as the predetermined information, and wherein the control unit performs control to set the first interval as the time interval in a case where at least one of conditions in which a temperature indicated by the circumstance is a first temperature and a humidity indicated by the circumstance is a first humidity is satisfied, and performs control to set the second interval as the time interval in a case where at least one of conditions in which the temperature indicated by the circumstance is a second temperature higher than the first temperature and the humidity indicated by the circumstance is a second humidity higher than the first humidity is satisfied.

9. The image forming apparatus according to claim 2, wherein the control unit is configured to use the information item of the recording material resistance as the predetermined information, and wherein the control unit performs control to set the first interval as the time interval in a case where an electrical resistance value indicated by the recording material resistance is a first electrical resistance value, and performs control to set the second interval as the time interval in a case where the electrical resistance value indicated by the recording material resistance is a second electrical resistance value greater than the first electrical resistance value.

10. The image forming apparatus according to claim 2, wherein the control unit is configured to use the information item of the passage time and the information item of the printing ratio as the predetermined information, and wherein the control unit performs control to set the first interval as the time interval in a case where a time indicated by the passage time is a time equal to a first time and performs control to set the second interval as the time interval in a case where the indicated time is a second time greater than the first time, and wherein, in a case where the printing ratio indicated by the printing ratio is a first printing ratio, the first time is shorter than the first time in a case where the printing ratio is a second printing ratio larger than the first printing ratio.

11. The image forming apparatus according to claim 10, wherein the control unit performs control to set the first interval as the time interval in a case where the indicated time is less than a predetermined threshold, and performs control to set the second interval as the time interval in a case where the indicated time is equal to or more than the predetermined threshold, and wherein, to compare the passage time, as corrected by the control unit, with the predetermined threshold, the control unit performs control to correct the passage time so that the indicated time is to be smaller in a case where the printing ratio is a second printing ratio.

12. The image forming apparatus according to claim 2, wherein the control unit is configured to use the information item of the printing ratio as the predetermined information, and wherein the control unit performs control to set the first interval as the time interval in a case where the printing ratio information is a first printing ratio, and performs control to set the second interval as the time interval in a case where the printing ratio is a second printing ratio greater than the first printing ratio.

13. The image forming apparatus according to claim 1, wherein, in a case where the control unit performs control to set the second interval as the time interval, the control unit is capable of changing the second interval based on the predetermined information.

14. A method for an image forming apparatus having a photosensitive member that is rotatable and configured to bear a toner image, a transfer member configured to perform a transfer of the toner image borne on the photosensitive member onto a recording material, a power supply configured to apply a voltage for the performed transfer to the transfer member, and a conveyance unit configured to convey the recording material to a transfer portion where the transfer member opposes the photosensitive member, the method comprising:

changing, in a case where an image is successively formed on a first recording material and a second recording material conveyed to the transfer portion following the first recording material, a time interval to a first interval or a second interval based on predetermined information concerning the transfer onto the first recording material, wherein the first recording material has a first width in a width direction perpendicular to a conveyance direction of the recording material and the second recording material has a second width greater than the first width in the width direction, wherein the time interval is an interval between a time when a trailing edge of the first recording material in the conveyance direction completely passes through the transfer portion and a time when a leading edge in the conveyance direction of the second recording material conveyed to the transfer portion immediately following the first recording material reaches the transfer portion, and wherein the first interval is a time period corresponding to a rotation equal to less than one rotation of the photosensitive member and the second interval is a time period corresponding to a rotation equal to one rotation or more than one rotation of the photosensitive member.

15. A non-transitory computer-readable storage medium storing a program to cause a computer to perform a method for an image forming apparatus having a photosensitive member that is rotatable and configured to bear a toner image, a transfer member configured to perform a transfer of the toner image borne on the photosensitive member onto a recording material, a power supply configured to apply a voltage for the performed transfer to the transfer member, and a conveyance unit configured to convey the recording material to a transfer portion where the transfer member opposes the photosensitive member, the method comprising:

changing, in a case where an image is successively formed on a first recording material and a second recording material conveyed to the transfer portion following the first recording material, a time interval to a first interval or a second interval based on predetermined information concerning the transfer onto the first recording material, wherein the first recording material has a first width in a width direction perpendicular to a conveyance direction of the recording material and the second recording material has a second width greater than the first width in the width direction, wherein the time interval is an interval between a time when a trailing edge of the first recording material in the conveyance direction completely passes through the transfer portion and a time when a leading edge in the conveyance direction of the second recording material conveyed to the transfer portion immediately following the first recording material reaches the transfer portion, and wherein the first interval is a time period corresponding to a rotation equal to less than one rotation of the photosensitive member and the second interval is a time period corresponding to a rotation equal to one rotation or more than one rotation of the photosensitive member.

* * * * *